US008726834B2

(12) United States Patent
Nakagawa et al.

(10) Patent No.: US 8,726,834 B2
(45) Date of Patent: May 20, 2014

(54) LIQUID APPLYING APPARATUS AND INK JET PRINTING APPARATUS

(75) Inventors: Yoshinori Nakagawa, Kawasaki (JP); Osamu Iwasaki, Tokyo (JP); Atsuhiko Masuyama, Yokohama (JP); Satoshi Masuda, Kawasaki (JP); Naoji Otsuka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 1306 days.

(21) Appl. No.: 11/946,014

(22) Filed: Nov. 27, 2007

(65) Prior Publication Data

US 2008/0134972 A1 Jun. 12, 2008

(30) Foreign Application Priority Data

Dec. 11, 2006 (JP) ..... 2006-333363
Oct. 23, 2007 (JP) ..... 2007-275478

(51) Int. Cl.
*B41F 33/00* (2006.01)
*B05C 11/00* (2006.01)

(52) U.S. Cl.
USPC ..... 118/692; 101/483

(58) Field of Classification Search
USPC ..... 118/692
See application file for complete search history.

(56) References Cited

U.S. PATENT DOCUMENTS 4,378,390 A * 3/1983 Yoshida et al. ..... 427/428.15
5,478,599 A * 12/1995 Iyer et al. ..... 427/355
5,833,804 A * 11/1998 Ruppel et al. ..... 156/578
5,937,255 A * 8/1999 Kagawa ..... 399/324
6,424,815 B1 7/2002 Kawamoto et al.
7,270,409 B2 9/2007 Iwasaki et al. ..... 347/103
7,395,778 B2 7/2008 Iwasaki et al. ..... 118/46
7,588,639 B2 9/2009 Iwasaki et al.

(Continued)

FOREIGN PATENT DOCUMENTS

JP 62047670 A 3/1987
JP 8-58069 3/1996

(Continued)

OTHER PUBLICATIONS

U.S. Appl. No. 12/178,948, filed Jul. 24, 2008 by Yoshinori Nakagawa, Naoji Otsuka and Osamu Iwasaki, entitled "Ink Jet Printing Apparatus".

(Continued)

*Primary Examiner* — Yewebdar Tadesse
*Assistant Examiner* — Charles Capozzi
(74) *Attorney, Agent, or Firm* — Fitzpatrick, Cella, Harper & Scinto

(57) ABSTRACT

An object of the present invention is to provide a liquid applying apparatus which can inhibit a variation in application amount associated with the individual variability of a component of the apparatus. According to the present invention, a liquid holding space in which a liquid is held is formed between the applying member and the liquid holding member. When the applying member moves, the liquid attached to the applying member is fed out of the liquid holding space together with the applying member. The liquid is applied to a medium. The application amount of liquid applied to the applying medium varies depending on the individual variability of a component such as a liquid applying member. The variation in liquid application amount is adjusted by adjusting section for adjusting, the rotation speed of the liquid holding member or the flow speed of the liquid flowing through the liquid holding space.

7 Claims, 22 Drawing Sheets

(56) References Cited

U.S. PATENT DOCUMENTS

| | | | | |
|---|---|---|---|---|
| 2002/0096077 | A1* | 7/2002 | Frankenberger | 101/484 |
| 2002/0152907 | A1* | 10/2002 | Koehler | 101/364 |
| 2003/0183099 | A1* | 10/2003 | De Vroome | 101/148 |
| 2005/0178323 | A1 | 8/2005 | Iwasaki et al. | 118/206 |
| 2005/0178324 | A1* | 8/2005 | Iwasaki et al. | 118/244 |
| 2005/0179760 | A1 | 8/2005 | Nakagawa et al. | 347/105 |
| 2006/0057500 | A1* | 3/2006 | Sawada et al. | 430/302 |
| 2008/0223290 | A1 | 9/2008 | Iwasaki et al. | 118/46 |

FOREIGN PATENT DOCUMENTS

| | | | | |
|---|---|---|---|---|
| JP | 2001-183937 | A | 7/2001 | |
| JP | 2005-254229 | A | 9/2005 | |
| WO | WO 2005037554 | A1 * | 4/2005 | B41F 31/22 |

OTHER PUBLICATIONS

Office Action issued on Japanese Patent Office Application No. 2007-275478, dated Nov. 27, 2012.

* cited by examiner

| SURFACE ROUGHNESS MEASURED VALUE | Ra ~ 1.3 | Ra1.3 ~ 1.6 | Ra1.6 ~ |
|---|---|---|---|
| SURFACE ROUGHNESS LEVEL | LEVEL 1 | LEVEL 2 | LEVEL 3 |
| | ↓ | ↓ | ↓ |
| PUMP SPEED | A | B | C |
| APPLICATION SPEED | F | E | D |

FIG.18

LIQUID APPLYING APPARATUS AND INK JET PRINTING APPARATUS

BACKGROUND OF INVENTION

1. Field of the Invention

The present invention relates to a liquid applying apparatus and an ink jet printing apparatus, and specifically, to a liquid applying apparatus that applies a liquid to a medium for a predetermined purpose, for example, for starting the coagulation of pigments earlier when printing is carried out using inks composed of the pigments as color materials. In particular, the present invention relates to control of the amount of liquid applied to the medium.

2. Description of the Related Art

Known such applying apparatuses supply a liquid to be applied, to an applying member such as a roller, which then applies the supplied liquid to a medium. Among the apparatuses using such an applying member for application, a configuration that seals a part of the roller to which an application liquid is supplied or applied is described in Japanese Patent Laid-Open No. 08-58069. The applying mechanism described in Japanese Patent Laid-Open No. 08-58069 applies inks to a roller in a gravure printing apparatus which has a pattern for a printing plate formed on a surface thereof. This mechanism uses an ink chamber having two doctor blades arranged at corresponding vertical positions along a peripheral surface of the roller and extending in a longitudinal direction of the roller and elastic members provided at the respective sides of each of the two doctor blades. The chamber is contacted with the peripheral surface of the roller to form a liquid chamber between the ink chamber and the roller. Then, the roller is rotated to supply or apply the application liquid to the roller.

The configuration supplying the liquid to the roller while abutting the chamber holding the liquid against the roller has the advantage of, for example, being able to prevent the possible leakage of the liquid. In particular, for ink jet printing apparatuses such as printers which comprise an applying mechanism, the configuration makes it possible to provide a printer which can prevent the leakage of the application liquid caused by a change in the posture of the apparatus during transportation and which is thus applicable to transportation.

However, the liquid applying apparatus described in Japanese Patent Laid-Open No. 08-58069 is disadvantageous in that the amount of liquid applied to a medium is likely to vary among products. That is, in the applying mechanism disclosed in Japanese Patent Laid-Open No. 08-5806, the chamber holding the liquid abuts against the roller. As the roller rotates, the liquid is attached to the roller via the abutting portion, and is conveyed and transferred to the medium. Thus, a variation in the condition of the abutment between the chamber and the roller may vary the amount of liquid applied to the roller.

For example, a variation the surface roughness of the roller surface among individual rollers may vary the condition of the abutment between the chamber and roller and thus the amount of liquid attached to the roller and fed to the exterior of the chamber. This may finally vary the amount of liquid transferred (applied) to the medium.

SUMMARY OF THE INVENTION

An object of the present invention is to provide a liquid applying apparatus and an ink jet printing apparatus which are able to inhibit a variation in application amount associated with the individual variability of a component of the apparatus.

A first aspect of the present invention is a liquid applying apparatus comprising a liquid applying unit comprising an applying member that applies a liquid to a medium and a liquid holding member that abuts against the applying member to form a liquid holding space in which a liquid is held, the applying member being rotated to apply the liquid in the liquid holding space to the medium via the applying member, and adjusting means for adjusting the amount of liquid applied to the medium on the basis of information on individual variability of a component of the liquid applying apparatus.

A second aspect of the present invention is an ink jet printing apparatus characterized by comprising the liquid applying apparatus and a print head that ejects ink to the medium to which the liquid has been applied by the liquid applying apparatus.

The present invention makes it possible to reduce a variation in application amount associated with the individual variability of a component of the liquid applying apparatus.

Further features of the present invention will become apparent from the following description of exemplary embodiments (with reference to the attached drawings).

BRIEF DESCRIPTION OF THE DRAWINGS

FIG. 18 is a diagram showing a table used for a circulation speed determining process and a application speed determining process according to an embodiment of the present invention;

DESCRIPTION OF THE EMBODIMENTS

Preferred embodiments of the present invention will be described below in detail with reference to the drawings.

1. Embodiment of the Liquid Applying Apparatus 1.1. General Configuration

Figure 1:
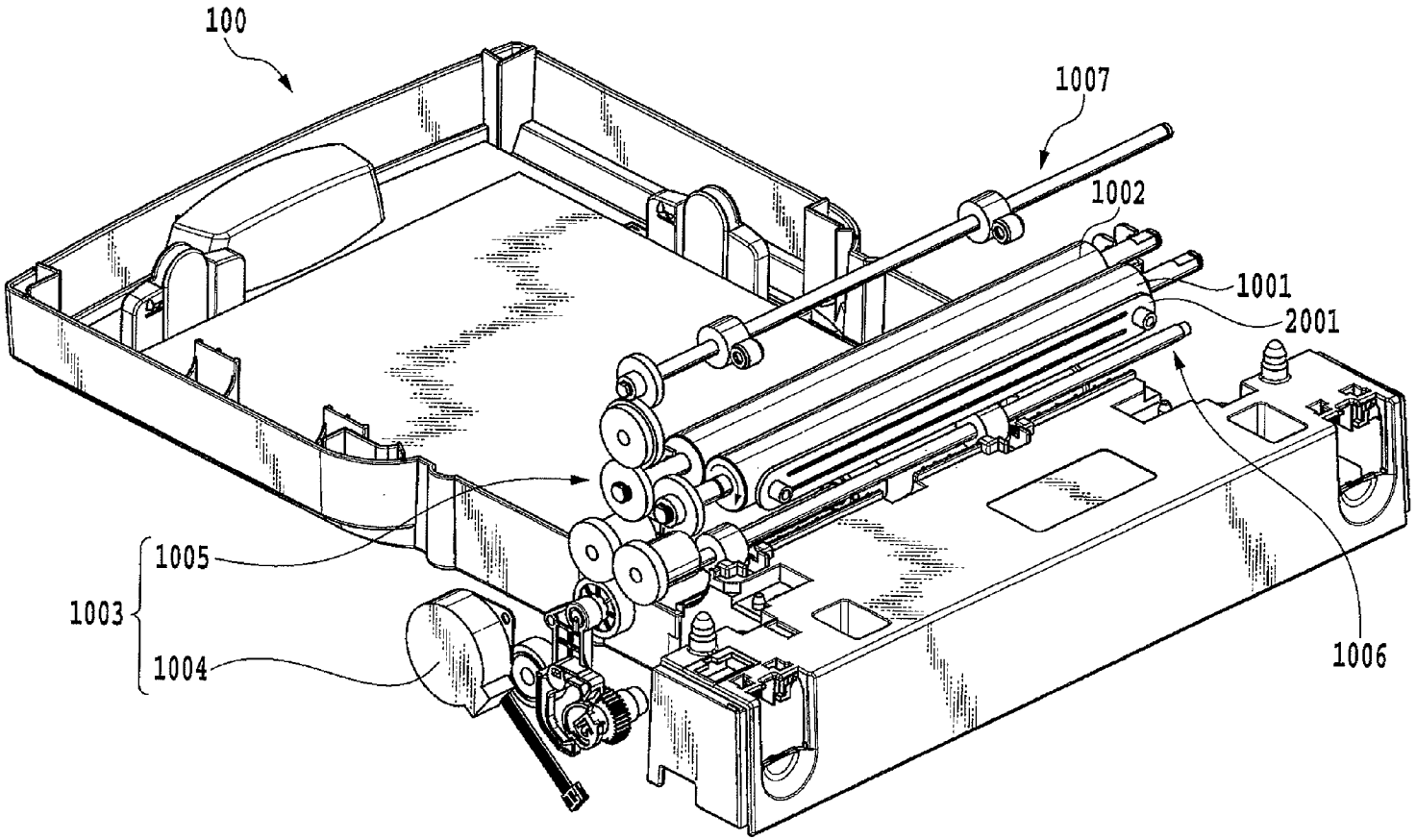
FIG. 1 is a perspective view generally showing the configuration of an embodiment according to a liquid applying apparatus of the present invention.

FIG. 1 is a perspective view generally showing the configuration of an embodiment according to a liquid applying apparatus 100 of the present invention. The liquid applying apparatus shown in FIG. 1 roughly has liquid applying unit for applying an application liquid to a medium to which a liquid is to be applied (this medium will be referred to as a applying medium in the description below) and liquid supplying unit for supplying an application liquid to the liquid applying unit.

The liquid applying unit has a cylindrical applying roller 1001, a cylindrical counter roller (medium supporting member) placed opposite the applying roller 1001, and a roller driving mechanism 1003 that drives the applying roller 1001. The roller driving mechanism 1003 comprises a roller driving motor 1004 and a transmission mechanism 1005 which transmits the driving force of the roller driving motor 1004 to the applying roller 1001 and which has a gear train and the like.

According to the present embodiment, the applying roller is formed of silicon rubber and has a hardness of 20°, and a diameter of 23.169 mm.

The liquid supplying unit has, for example, a liquid holding member 2001 that holds the application liquid between the liquid holding member 2001 and a peripheral surface of the applying roller 1001, and a liquid channel 3000 (not shown in FIG. 1) described later and through which the liquid is supplied to the liquid holding member 2001. The applying roller 1001 and the counter roller 1002 are rotatively movably supported by respective shafts which are parallel to each other and each of which has opposite ends rotatively movably attached to a frame (not shown). Further, the liquid holding member 2001 extends almost all along the applying roller 1001 in a longitudinal direction. The liquid holding member 2001 is movably attached to the frame via a mechanism that enables the liquid holding member 2001 to contact with and separate from the peripheral surface of the applying roller 1001.

The liquid applying apparatus according to the present embodiment further comprises an applying medium supplying mechanism 1006 which consists of a pickup roller or the like to convey an applying medium to a nip portion between the applying roller 1001 and the counter roller 1002. Further, in a conveying path for applying media, a sheet discharging mechanism 1007 consisting of a sheet discharging roller or the like is provided downstream of the applying roller 1001 and the counter roller 1002 to convey a applying medium on which the application liquid has been applied, to a sheet discharging section (not shown). Like the applying roller and the like, the sheet supplying mechanism and the sheet discharging mechanism are operated under the driving force of the driving motor 1004 transmitted via the transmission mechanism 1005.

The application liquid used in the present embodiment is intended to facilitate the coagulation of pigments when printing has been carried out using inks including the pigments as color materials.

An example of the components of the application liquid is shown below.

Tetrahydrate of calcium nitrate: 10%
Glycerin: 42%
Surface active agent: 1%
Water: remaining amount The application liquid has a viscosity of 5 to 6 cp (centipoise) at 25° C.

In applications of the present invention, of course, the application liquid is not limited to the one described above. For example, a liquid including a component which insolubilizes or coagulate a dye may be used as another application liquid. A liquid containing components to restrain a curl (phenomenon in which a medium becomes curve shape) of the application medium may be used.

If water is used as a liquid to be applied, the slidability of the abutting portion between the applying roller and the liquid holding member according to the present invention is improved by containing a component that reduces surface tension in the liquid. In the above example of the components of the liquid to be applied, the glycerin and the surface active agent are components that reduce the surface tension of water.

1.2. Liquid Applying Mechanism

Figure 2:
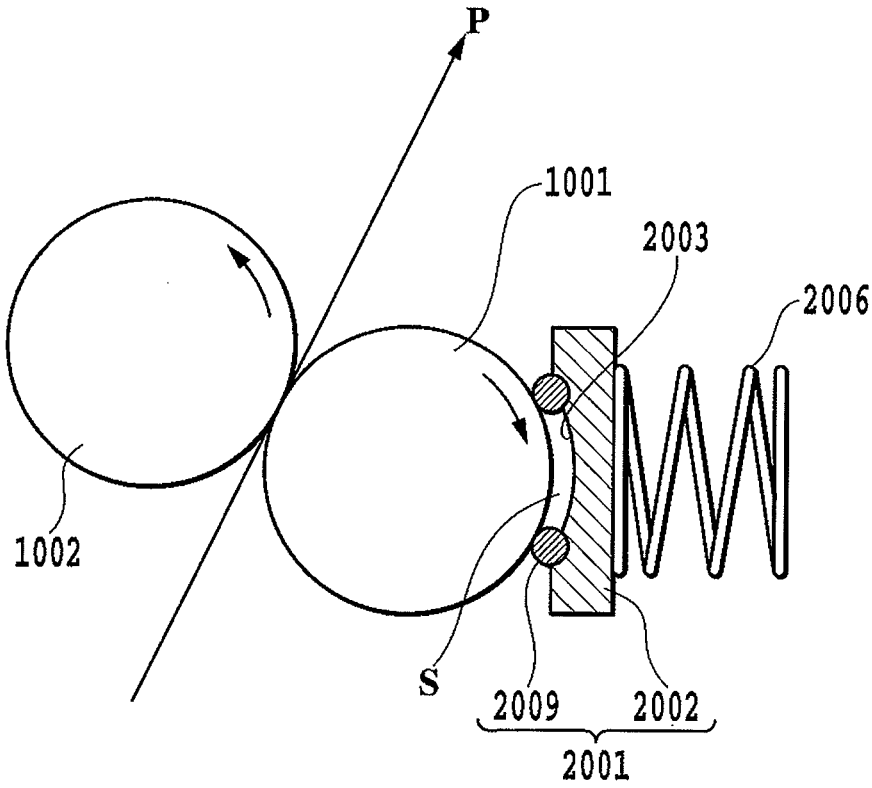
FIG. 2 is a vertical side view showing an example of the arrangement of a applying roller, a counter roller, a liquid holding member, and the like which are shown in FIG. 1.

FIG. 2 is a vertical sectional view illustrating an example of the arrangement of the applying roller 1001, the counter roller 1002, and the liquid holding member 2001.

The counter roller 1002 is urged by urging means (not shown) toward the peripheral surface of the applying roller 1001. By rotating the applying roller 1001 clockwise in the figure, it is possible to sandwich an applying medium P on which the application liquid is to be applied, between the rollers, while conveying the applying medium P in the direction of an arrow in the figure.

According to the present embodiment, the applying roller is formed of iron and has a diameter of 14 mm.

Further, when urged and abutted against the peripheral surface of the applying roller 1001 under the urging force of a spring member (pressing member) 2006, the liquid holding member 2001 forms an elongate liquid holding space S extending all over an area applied the liquid by the applying roller 1001. The application liquid from a liquid channel 3000, described later, is supplied to the interior of the liquid holding space S via the liquid holding member 2001. In this case, since the liquid holding member 2001 is configured as described below, the application liquid can be prevented from inadvertently leaking from the liquid holding space S to the exterior while the applying roller 1001 is stopped.

FIGS. 3 to 8 show the configuration of the liquid holding member 2001.

Figure 3:
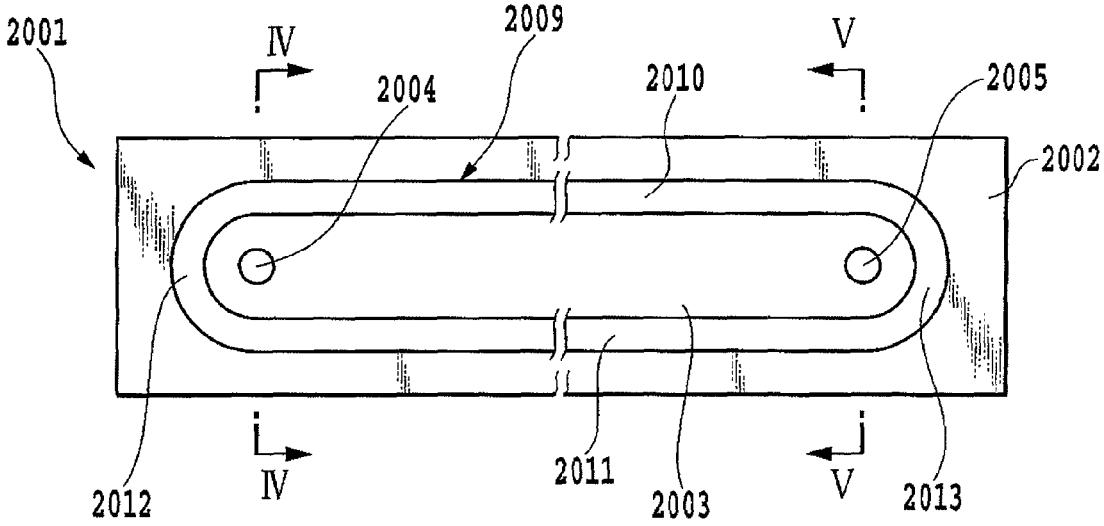
FIG. 3 is a front view of the liquid holding member shown in FIGS. 1 and 2.

As shown in FIG. 3, the liquid holding member 2001 has a space forming base material 2002 and an annular abutting member 2009 located on one surface of the space forming base material 2002.

The abutting member 2009 is vertically and laterally symmetrically shaped and has an upper edge 2010 and a lower edge 2011 that constitute an upper portion and a lower portion, respectively, when the abutting member 2009 is mounted in the present apparatus, and a left side edge 2012 and a right side edge 2013; the upper and lower edges 2010 and 2011 and the left and right side edges 2012 and 2013 are integrally formed of an elastic material. The integral abutting member 2009 is secured to a space forming base material. A concave portion 2003 is formed in a surface of the space forming base material 2002 on which the abutting member 2009 is provided, to form a given gap between the applying roller 1001 and the space forming base material 2002. The upper edge 2010 and lower edge 2011 of the abutting member 2009 are secured to the concave portion 2003 along the upper and lower ends thereof. The left and right side edges 2012 and 2013 are formed like circular arcs so as to prevent the possible biasing of the abutting surface between the applying roller 1001 and the abutting member 2009. Thus, the horizontal cross section of the abutting member 2009 maintains the circular arc thereof conforming to the shape of the applying roller 1001 even when the abutting member 2009 is separated from the applying roller 1001.

As described above, in the liquid holding member according to this embodiment, the abutting member 2009, formed integrally and seamlessly, is continuously abutted without a gap against the outer peripheral surface of the applying roller 1001 under the urging force of the spring member 2006. As a result, the liquid holding space S is substantially closed by the abutting member 2009, one surface of the space forming base material, and the outer peripheral surface of the applying roller 1001. The liquid is held in this space. Then, when the rotation of the applying roller 1001 is stopped, the abutting member 2009 and the outer peripheral surface of the applying roller 1001 maintain a liquid tight state. The liquid can be reliably prevented from leaking to the exterior.

On the other hand, when the applying roller 1001 rotates, the applying liquid flows slipperily between the outer peripheral surface of the applying roller 1001 and the abutting member 2009. The applying liquid then attaches to the outer peripheral surface of the applying roller in layers. In this embodiment of the present invention, as described later in FIG. 13, the volume of the applying liquid applied to the surface of the applying roller 1001 is controlled.

In this case, when the applying roller 1001 is stopped and the liquid tight state is established between the outer peripheral surface of the applying roller 1001 and the abutting member 2009, the liquid cannot flow out of the space as described above. In this case, the abutting state of the abutting member 2009 includes not only direct abutment against the outer peripheral surface of the applying roller 1001 but also abutment against the outer peripheral surface via a liquid film formed under a capillary force.

Figure 4:
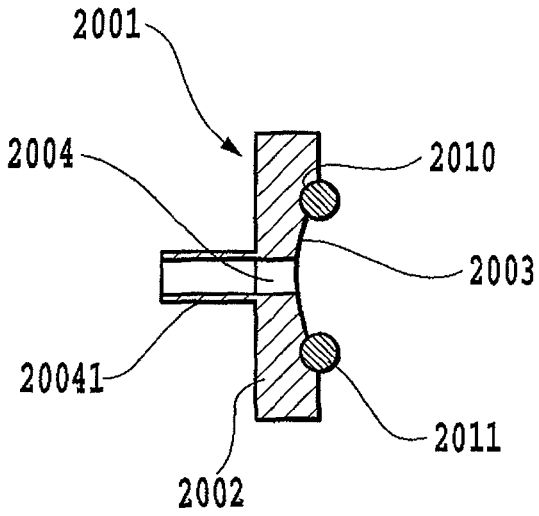
FIG. 4 is an end view showing an end surface of the liquid holding member shown in FIG. 3, the view taken along line IV-IV in FIG. 3.
Figure 5:
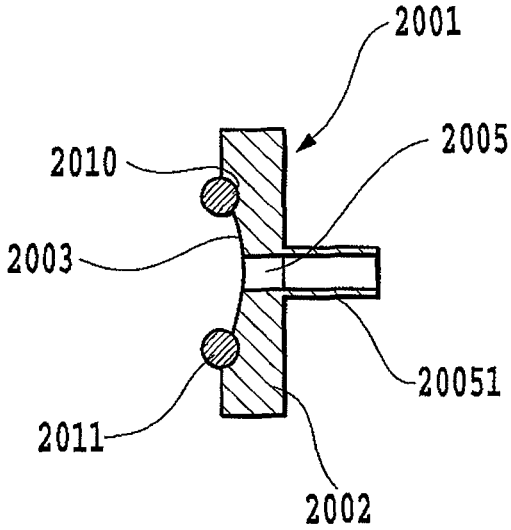
FIG. 5 is an end view showing the end surface of the liquid holding member shown in FIG. 3, the view taken along line V-V in FIG. 3.
Figure 6:
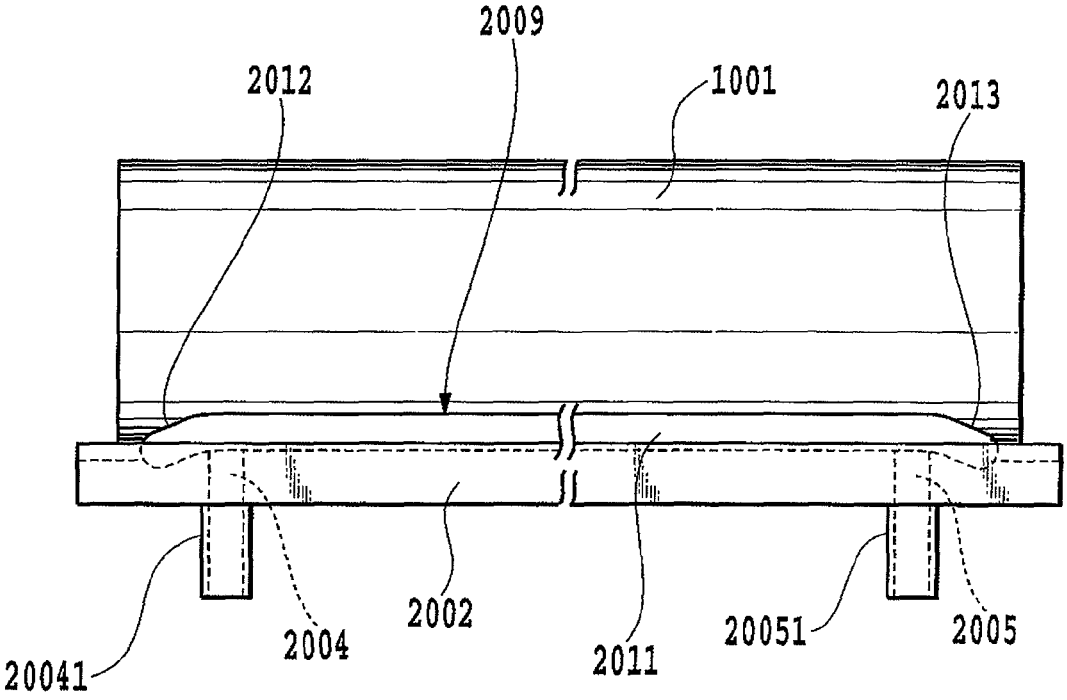
FIG. 6 is a plan view of the liquid holding member shown in FIG. 3.
Figure 7:
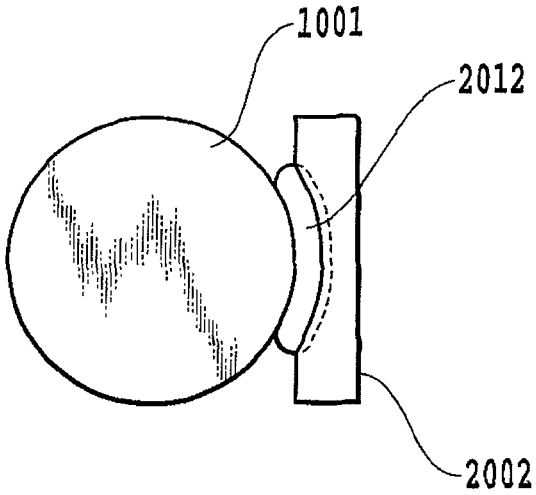
FIG. 7 is a left side view showing how an abutting portion of the liquid applying member shown in FIG. 3 is abutted against a liquid applying roller.
Figure 8:
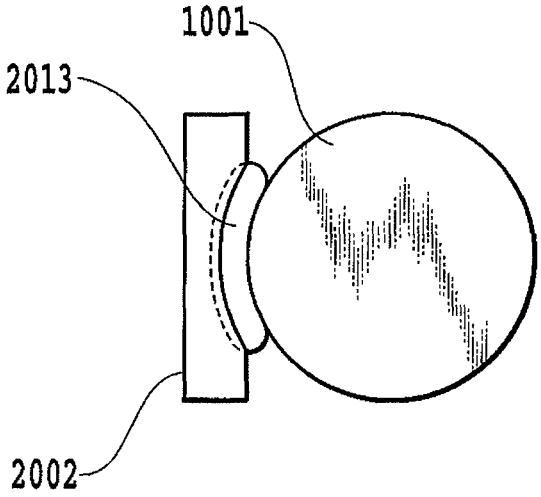
FIG. 8 is a right side view showing how the abutting portion of the liquid applying member shown in FIG. 3 is abutted against the liquid applying roller.

On the other hand, as shown in FIGS. 3 to 5, a liquid supplying port 2004 and a liquid collecting port 2005 are formed in an area of the space forming base material 2002 which is surrounded by the abutting member 2009; the liquid supplying port 2004 and the liquid collecting port 2005 have holes penetrating the space forming base material 2002. The liquid supplying port 2004 and the liquid collecting port 2005 are communicating with cylindrical connecting portions 20041 and 20051 projected from a back surface of the space forming base material. Further, the connecting portions 20041 and 20051 are connected to a liquid channel 3000 described later. In this embodiment, the liquid supplying port 2004 is formed near one end of an area surrounded by the abutting member 2009 (the left end in FIG. 3), while the liquid collecting port 2005 is formed near the other end of the same area (the right end in FIG. 3). The liquid supplying port 2004 is used to supply the application liquid provided through the liquid channel 3000, to the liquid holding space S. The liquid collecting port 2005 is used to allow the liquid in the liquid holding space S to flow out to the liquid channel 3000. The supply and flow out of the application liquid allows the liquid to flow from the left end to right end of the liquid holding space S.

1.3. Application Liquid Channel

Figure 11:
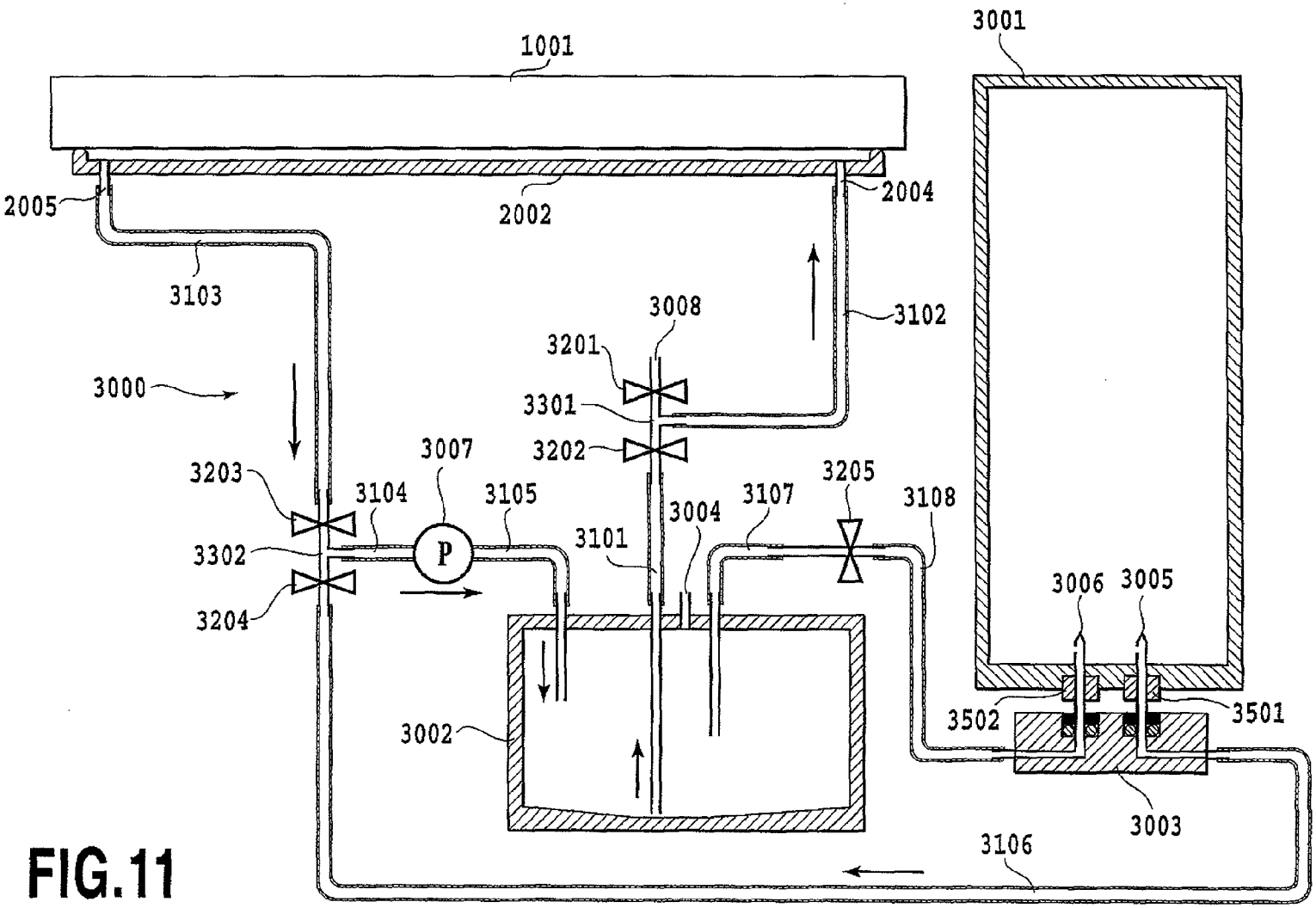
FIG. 11 is a diagram generally showing the configuration of a liquid channel in the liquid applying apparatus according to the embodiment of the present invention.

FIG. 11 is a diagram schematically showing the configuration of a liquid channel 3000 coupled to a liquid holding member 2001 to supply the application liquid to the liquid holding member or to collect the application liquid from the liquid holding member. The liquid channel 3000 comprises a tube 3101 and a tube 3102 which constitute a first channel (supply channel) coupling the liquid supply port 2004 in the space forming base material 2002, constituting the liquid holding member 2001, to a buffer tank 3002 storing the application liquid. The liquid channel 3000 comprises a rube 3103, a tube 3104, and a tube 3105 which constitute a second channel (collecting channel) coupling the liquid collecting port 2005 in the space forming base material 2002 to the buffer tank 3002. An air communication port 3004 is formed in the buffer tank 3002.

A first T-shaped channel 3301 coupling three ports together is formed between the tube 3101 and tube 3102, constituting the first channel. The first T-shaped channel 3301 allows one of the three ports, a coupling port 3008 to communicate with the atmosphere. A first shut-off valve 3201 is provided at a position of the first T-shaped channel 3301 closer to the communication port 3008, which is in communication with the atmosphere, than the junction between the three ports; the first shut-off valve 3201 allows the communication or blockage between the communication port 3008 and the first T-shaped channel 3301. The first T-shaped channel 3301 is coupled to the buffer tank 3002 via the tube 3101. A second shut-off valve 3202 is provided at a position of the first T-shaped channel 3301 closer to the coupling port coupled to the tube 3101, than the junction between the three ports; the second shut-off valve 3202 allows the communication or blockage between the tube 3101 and the first T-shaped channel 3301. The first T-shaped channel 3301 couples the remaining coupling port to the liquid supply port 2004 via the tube 3102. The configuration of the first shut-off valve 3201, second shut-off valve 3202, and first T-shaped channel 3301 allows the coupling target of the tube 3102 to be selected from between the atmosphere and the buffer tank 3002 on the basis of the combination of the communications or blockages achieved by the two shut-off valves.

A pump (liquid directing means) 3007 is located in the second channel, including the tube 3103, tube 3104, and tube 3105, to forcibly direct the application liquid and air through the liquid channel 3000 toward the buffer tank 3002. The tube 3104 is coupled to a side (hereinafter also referred to as the "upstream side of the pump") of the pump 3007 into which the applying liquid flows. The tube 3105 is coupled to a side (hereinafter also referred to as the "downstream side of the pump") of the pump 3007 out of which the applying liquid flows. The tube 3105 couples the buffer tank 3002 to the pump 3007. The tube 3104 couples the pump 3007 to a second T-shaped channel 3302 coupling the pump 3007 to three ports. The tube 3103 couples the second T-shaped channel 3302 to the liquid collecting port 2005.

By coupling the buffer tank 3002 to the space forming base material 2002 through the first channel and the second channel and driving the pump 3007, it is possible to circularly supply the application liquid in the buffer tank 3002 to the space forming base material 2002.

Moreover, the liquid channel 3000 comprises a third channel (refilling channel) coupling the second channel to a replaceable replacement tank 3001 in which the application liquid is stored, and a fourth channel coupling the buffer tank 3002 to the replacement tank 3001. The replacement tank 3001 has a larger volume than the buffer tank 3002.

The tube 3106, included in the third channel, is coupled to the replacement tank 3001 via an injection needle-like first coupling port 3005 and a pedestal 3003 constituting a coupling channel. That is, the injection needle-like first coupling port 3005 pierces rubber 3501 provided at the bottom of the replacement tank 3001 to couple the tube 3108 to the replacement tank 3001. The other port of the tube 3106 is coupled to the second T-shaped channel 3302. In the present embodiment, the tube 3106 constitutes a refilling channel through which the application liquid is fed from the replacement tank 3001 to the buffer tank 3002.

The second T-shaped channel 3302 comprises a third shut-off valve 3203 at a position closer to the coupling port coupled to the tube 3103, than the junction between the three ports; the third shut-off valve 3203 allows the communication or blockage between the tube 3103 and the second T-shaped channel 3302. The second T-shaped channel 3302 also comprises a fourth shut-off valve 3204 at a position closer to the coupling port coupled to the tube 3106, than the junction between the three ports; the fourth shut-off valve 3204 allows the communication or blockage between the tube 3106 and the second T-shaped channel 3302. The configuration of the third shut-off valve 3203, fourth shut-off valve 3204, and second T-shaped channel 3302 allows the coupling target of the tube 3104 to be selected from between the replacement tank 3001 and the space forming base material 2002 on the basis of the combination of the communications or blockages achieved by the two shut-off valves.

The fourth channel includes a tube 3107 and a tube 3108. The tube 3108, included in the fourth channel, is coupled to the replacement tank 3001 via the pedestal 3003, constituting the injection needle-like second coupling port 3006 and a coupling channel. That is, the injection needle-like second coupling port 3006 pierces rubber 3502 provided at the bottom of the replacement tank 3001 to couple the tube 3108 to the replacement tank 3001. The replacement tank 3001 is in communication with the buffer tank 3002 via a fifth shut-off valve 3205 that allows the switching between the communication and blockage between the tube 3107 and the tube 3108.

Each shut-off valve is switched in accordance with a control signal from a control section 40000, described below, to fill, supply, and collect the application liquid.

Description will be given below of the positions of the second T-shaped channel, third shut-off valve, and fourth shut-off valve, which joins the tube 3103 for collecting the application liquid to the tube 3106 and to switch between the tube 3104 and the channel of the tubes 3103 and 3106. The second T-shaped channel, the third shut-off valve, and the fourth shut-off valve may be arranged at any positions between the pump 3007 and the liquid collecting port 2005. As described below in another embodiment of the liquid channel, the second T-shaped channel, the third shut-off valve, and the fourth shut-off valve may be arranged between the liquid supply port 2004 and the buffer tank 3002. That is, the second T-shaped channel, the third shut-off valve, and the fourth shut-off valve may be arranged at any positions upstream of the pump 3007.

The present embodiment joins the collecting channel and the refilling channel together upstream of the pump 3007, and switches between the coupling between the channel connected to the pump 3007 and the collecting channel and the coupling between the channel connected to the pump 3007 and the refilling channel. The switching prevents the refilling channel to be coupled to the pump 3007 after the collecting pump has been coupled to the pump 3007. Thus, at this time, the pump 3007 allows the application liquid to be circulated through the first channel, the liquid holding space S, and the second channel and also allows the application liquid to be supplied to and collected from the liquid holding space S. On the other hand, when the switching couples the refilling channel to the pump 3007, the collecting channel is not coupled to the pump 3007. Thus, at this time, the application liquid can be fed from the replacement tank 3001 to the buffer tank 3002 via the third channel for refilling.

Thus, in the present embodiment, the collecting channel and the refilling channel are joined together and switched, upstream of the pump 3007, to shut off the channel not communicating with the pump 3007, from the pump 3007. This allows the single pump to control the channel having the buffer tank 3002 and the replacement tank 3001.

Furthermore, the pump 3007 is drivingly controlled to circulate the application liquid between the pump 3007 and the liquid holding member 2001 to control the flow speed of the application liquid flowing through the liquid holding member 2001 from the liquid supply port 2004 toward the liquid collecting port 2005, as described below with reference to FIG. 13 and subsequent figures.

1.4. Control System

Figure 12:
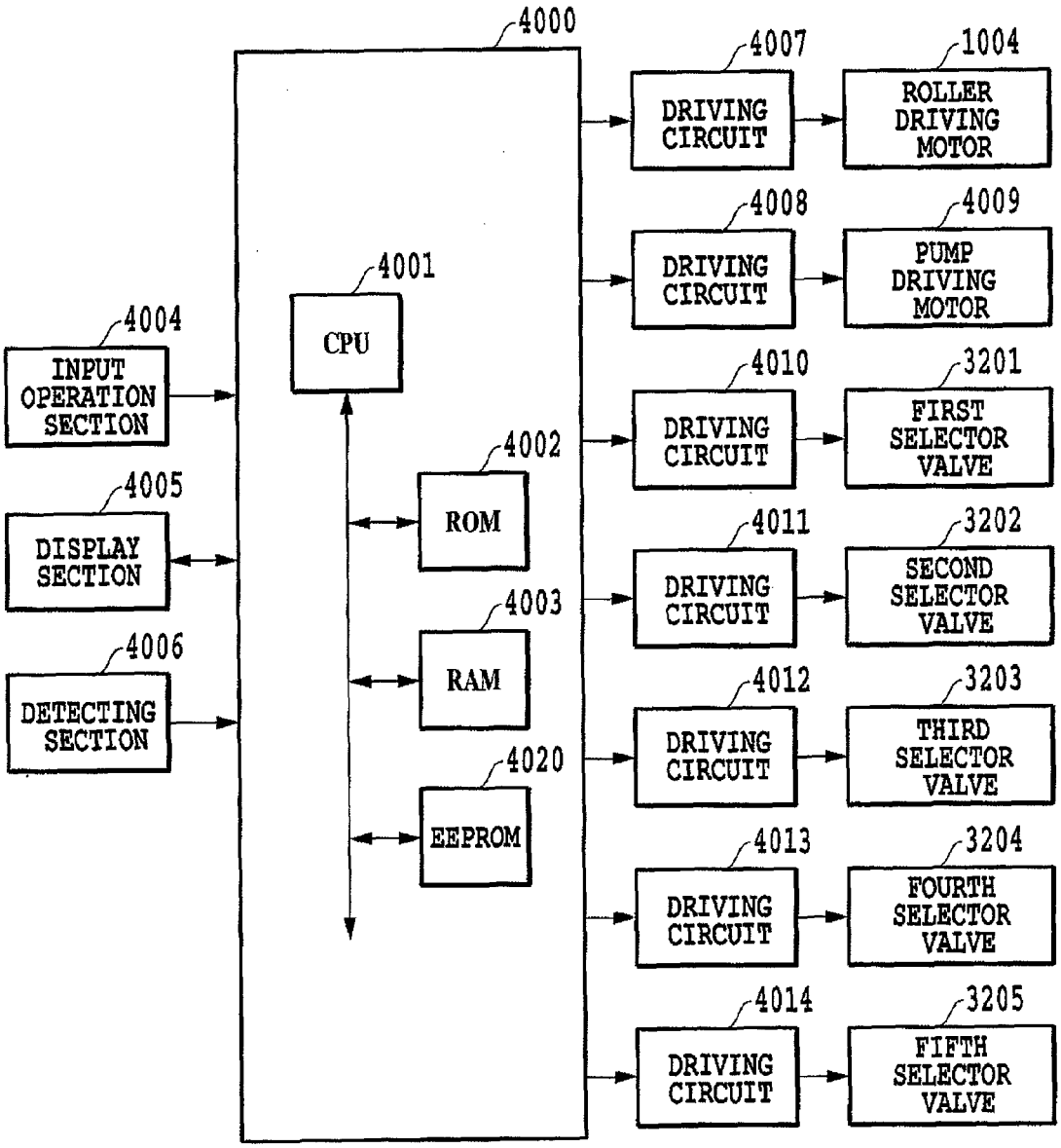
FIG. 12 is a block diagram generally showing the configuration of a control system according to the embodiment of the present invention.

FIG. 12 is a block diagram generally showing the configuration of the control system in the liquid applying apparatus according to the present embodiment.

In the figure, reference numeral 4000 denotes a control section 4000 as control means for controlling the whole liquid applying apparatus. The control section 4000 has a CPU 4001 that performs various processes such as calculations, control, and determinations. The control section 4000 also has a ROM 4002 that stores control programs for processes described below with reference to FIG. 13 and a RAM 4003 that temporarily stores data used during process operations by the CPU 4001 as well as input data. The control section 4000 further comprises an EEPROM 4020 that stores and holds parameters (individual variability information) for individual variability, affecting the application amount of the present apparatus, referenced in order to control the flow speed or application speed of the application liquid, as described below. The control section 4000 further comprises a timer for sensing the time for which the present apparatus has been or has not been used.

The control section 4000 connects to an input operation section 4004 including a keyboard, various switches, or the like with which predetermined instructions or data are input, a display section 4005 that provides various displays including inputs to and the set state of the liquid applying apparatus, and a detecting section 4006 including a sensor or the like which detects the position of a applying medium or the operational state of each section. The control section 4000 also connects to the roller driving motor 1004, a pump driving motor 4009, an air communicating valve 3005, and the selector valve 3006, via driving circuits 4007, 4008, 4010, and 4011.

1.5. Liquid Applying Operation Sequence

Description will be given of a liquid applying process executed by the configuration of the applying apparatus described above. The process includes the control of the circulation speed and the application speed according to an embodiment of the present embodiment. That is, the process includes the control of the speed of the flow (circulating flow) generated in the liquid holding member 2001 by the circulation associated with the supply and collection of the applying liquid to and from the liquid holding member 2001 as well as the control of the rotation speed of the applying roller.

Figure 13:
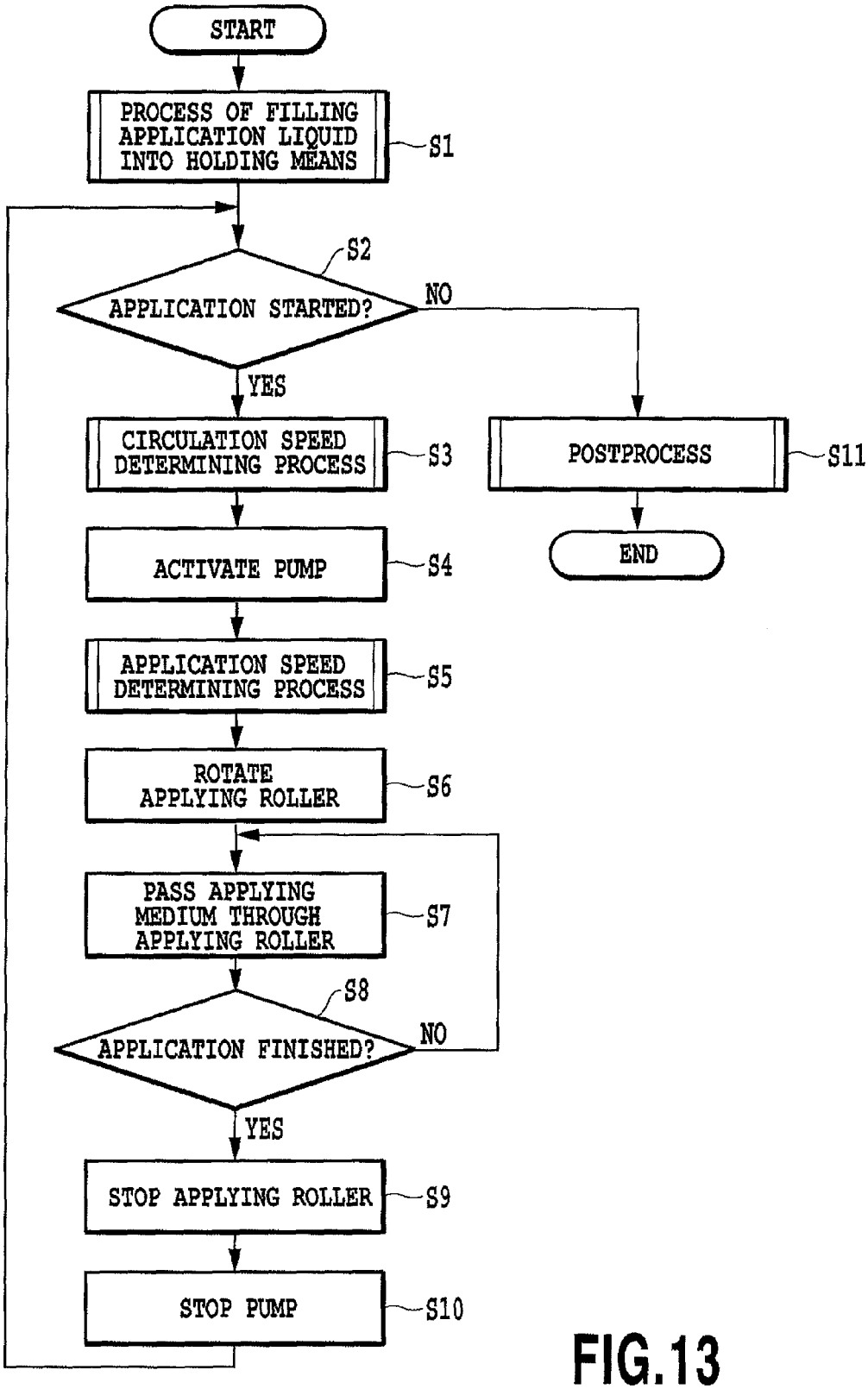
FIG. 13 is a flowchart showing a liquid applying operation sequence according to the embodiment of the present invention.

FIG. 13 is a flowchart showing a process procedure for liquid application performed by the liquid applying apparatus according to an embodiment of the present invention. Steps for the liquid application will be described below with reference to the flowchart.

Powering on the liquid applying apparatus allows the control section 4000 to execute the applying operation sequence described below, in accordance with the flowchart shown in FIG. 13.

The open and closed states of the shut-off valves shown in FIG. 11 are combined in four ways corresponding to "uncontrolled", "refilling", "application", and "collection" in Table 1. The control section 4000 selects the appropriate combination of the states of the apparatus, and sends control signals to the shut-off valves so that the shut-off valves perform operations corresponding to the selected combination.

TABLE 1

| | First shut-off valve | Second shut-off valve | Third shut-off valve | Fourth shut-off valve | Fifth shut-off valve |
|---|---|---|---|---|---|
| Uncontrolled | open | close | close | close | close |
| Refilling | close | close | close | open | open |
| Circulation | close | open | open | close | close |
| Collection | open | close | open | close | close |

Here, the "uncontrolled" state refers to the states of the shut-off valves observed with the application liquid collected from the liquid holding space S. The "refilling" state refers to the states of the shut-off valves observed while the application liquid is being fed from the replacement tank to the buffer tank for refilling. The "circulation" state refers to the states of the shut-off valves observed while the application liquid is being circulated through the buffer tank, the first channel, the liquid holding space S, and the second channel. The "collection" state refers to the states of the shut-off valves observed while the application liquid is being returned from the liquid holding space S and fed into the buffer tank.

1.5.1. Filling Step

In FIG. 13, in step S, the filling step of filling the application liquid into the applying space S is executed. In the filling step, the shut-off valves are set for the open and close combination for the "circulation" state, and the pump 3007 is driven for a given time. This open and close combination allows the buffer tank 3002 to communicate with the liquid applying space S through the first channel and the second channel. Thus, if the liquid applying space S and the first and second channels are not filled with the application liquid, the pump feeds the air in the pump to the buffer tank 3002. The air is discharged from the buffer tank 3002 to the atmosphere through the air communication port 3004, with the application liquid filled into the appropriate portions. If the application liquid has already been filled into the appropriate portions, the application liquid flows through these portions so as to have the appropriate concentration and viscosity. This initial operation allows the application liquid to be supplied to the applying roller 1001 and thus applied to the applying medium.

1.5.2. Refilling Step

In step S1, if a sensor or the like as a level managing means for sensing the height of the liquid surface in the liquid holding space determines that the application liquid is insufficiently filled in the buffer tank 3002, the shut-off valves are set for the open and close combination for the "refilling" state. At the same time, the pump 3007 is driven for a given time. The open and close combination allows the buffer tank 3002 to communicate with the replacement tank 3001 through the third channel and the fourth channel. The buffer tank 3002 is thus filled with the application liquid.

1.5.3. Circulation Speed Determining Step

Then, an application start instruction is input to the apparatus (step S2). A circulation speed determining process (step 3) is thus executed before the pump 3007 is driven again. In the present embodiment, in the subsequent pump activating step, the pressure in the liquid holding space is controlled by controlling, in accordance with the determined circulation speed, the speed of a circulating flow generated in the liquid holding space, formed between the liquid holding member 2001 and the applying roller 1001. This results in a change in the state of the flow (movement) of the application liquid in a portion (a site N shown in FIG. 9) in which the abutting member 2009 of the liquid holding member 2001 abuts against the applying roller 1001, controlling the amount of application liquid adhering to the application roller and thus leaving the abutting portion N. The amount of application liquid transferred (applied) to the applying medium P is thus controlled.

Figure 14:
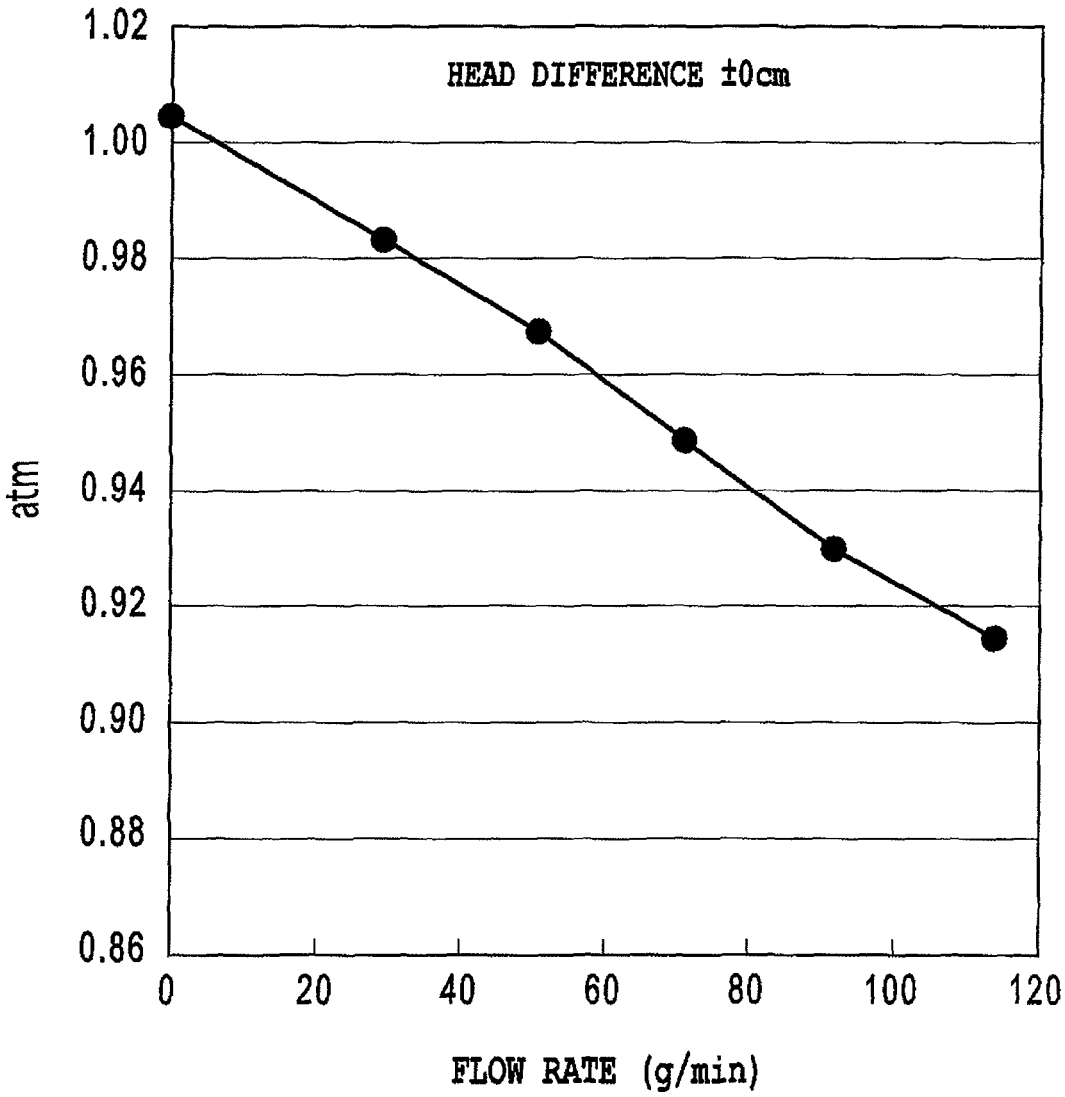
FIG. 14 is a diagram showing the pressure in the liquid holding space in the liquid applying apparatus with respect to the flow rate of a circulating flow.

FIG. 14 is a diagram showing the pressure in the liquid holding space S with respect to the flow rate of the circulating flow. Since the flow in the liquid holding space has a fixed cross section, the flow rate corresponds to the flow speed. FIG. 14 shows the average pressure in the liquid holding space in the flow direction when in the channel shown in FIG. 11, the hydraulic head difference between the buffer tank 3002 and the liquid holding member 2001 is 0 cm. The distribution of the pressure corresponds to the distribution of the flow speed in the liquid holding space in the flow direction. However, the pressure shows the tendency shown in FIG. 14 in any places.

Figure 15:
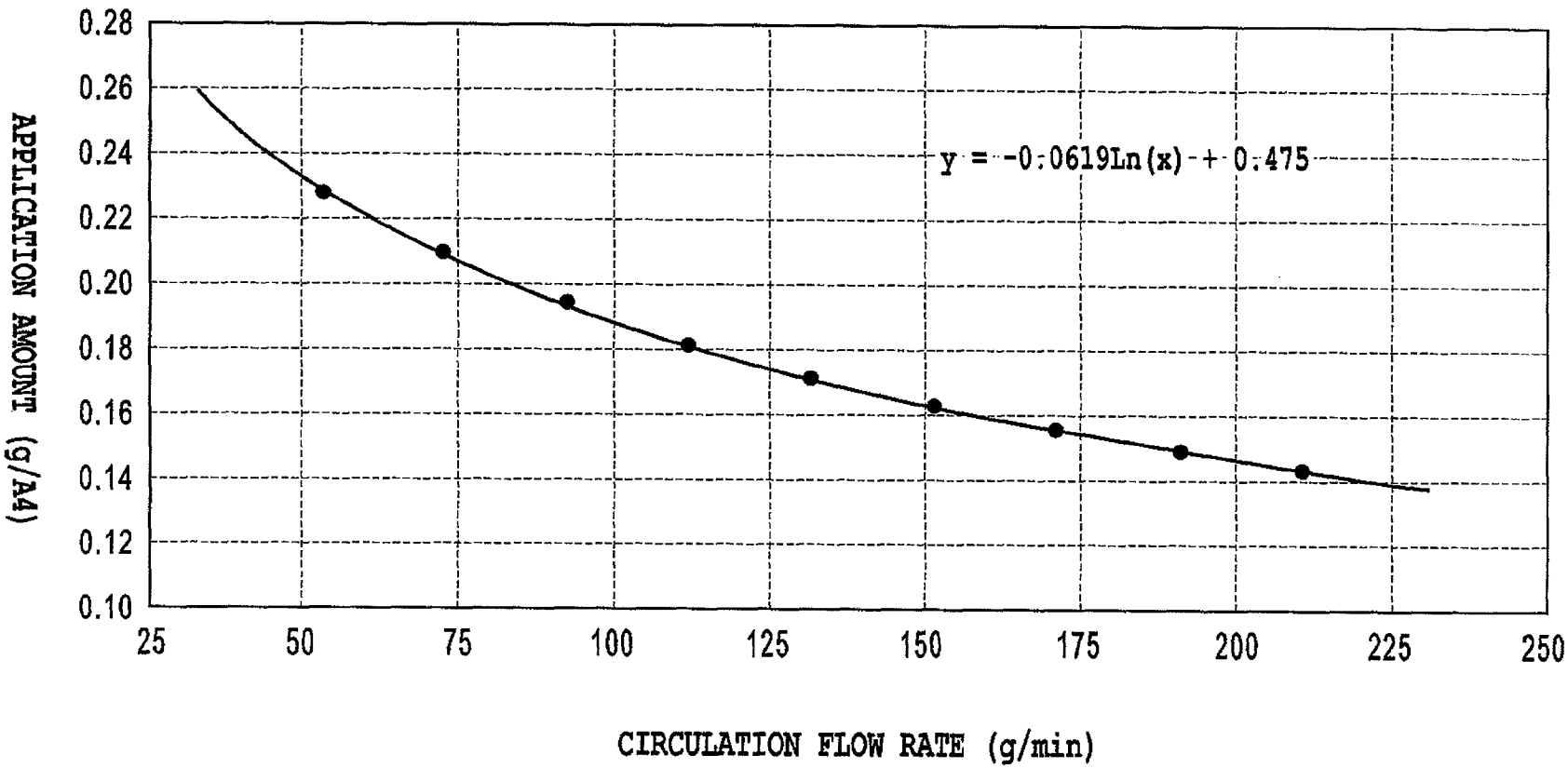
FIG. 15 is a diagram showing the relationship between application amount and the flow rate of the circulating flow.

As is apparent from FIG. 14, the pressure in the liquid holding space decreases with increasing flow speed. The application amount decreases consistently with the pressure in the liquid holding space. FIG. 15 is a diagram showing the relationship between the flow rate (thus, the flow speed) of the circulating flow and the application amount. As is apparent from the figure, the application amount decreases with increasing flow speed. The reason is as follows.

That is, a reduction in the pressure in the liquid holding space increases the abutting pressure of the abutting member 2009 on the applying roller 1001. This increases the contact area of the abutting portion N between the abutting member 2009 and the applying roller 1001 to reduce the gap in the abutting portion N. This inhibits the liquid from passing through the abutting portion N. Thus, changing (increasing or reducing) the flow speed changes the state of the abutting portion N and thus the amount of application liquid passing out from the liquid holding member 2001 through the gap in the abutting portion N.

Thus, when the parameter is the pressure in the liquid applying member or the flow speed of the circulation speed, the application amount can be controlled by the circulating flow rate (g/min) of the application liquid in the liquid holding space S as shown in FIG. 15. In the present embodiment, the EEPROM 4020 stores and holds a parameter (individual variability information) based on the individual variability of components of the liquid applying apparatus, which affects the application amount. The circulation amount is determined on the basis of the parameter. This allows adjustments to be made so as to inhibit a possible variation in application amount caused by the individual variability of any component.

The abutting portion N is formed of the abutting member and the applying roller along the longitudinal direction of the liquid holding member 2001. As described above, the pressure in the liquid holding space is distributed along the longitudinal direction. Consequently, the amount of application liquid passing through the abutting portion N may vary along the longitudinal direction of the liquid holding member. However, the variation in the amount is insufficient to be recognized as uneven application after the application liquid has been applied to the applying medium. Of course, the uneven application may occur if an extreme negative pressure gradient is formed, for example, if the liquid holding member is thinner and longer. However, a configuration with such an extreme negative pressure gradient may pose another problem such as an insufficient motor torque resulting from sticking of the liquid holding member. Moreover, leakage may occur in the abutting portion N, causing air to flow into the abutting portion N. Such a configuration is thus unpractical.

As described above, the circulation speed determining process in the present embodiment determines the circulation speed, enabling the application amount to be controlled (adjusted), in accordance with the parameter (individual variability information) for the properties of the components, which may vary the application amount. This makes it possible to inhibit a possible variation in application amount resulting from the individual variability.

The pump is driven at a pump speed corresponding to the thus determined circulation amount (step S4).

1.5.4. Application Speed Determining Step

Referring back to FIG. 13, after the circulation speed determining process (step S3) is finished, the pump driving is started at the determined pump speed (step S4). An application speed determining process (step S5) is executed before the applying roller performs a rotating operation. In the present embodiment, the subsequent applying roller rotating step controls the rotation speed of the applying roller in accordance with the determined application speed, controlling the amount of application liquid passing through the portion (the site N shown in FIG. 9) in which the abutting member 2009 abuts against the applying roller 1001. This allows the control of the amount of application liquid transferred (applied) to the applying medium P.

Figure 16:
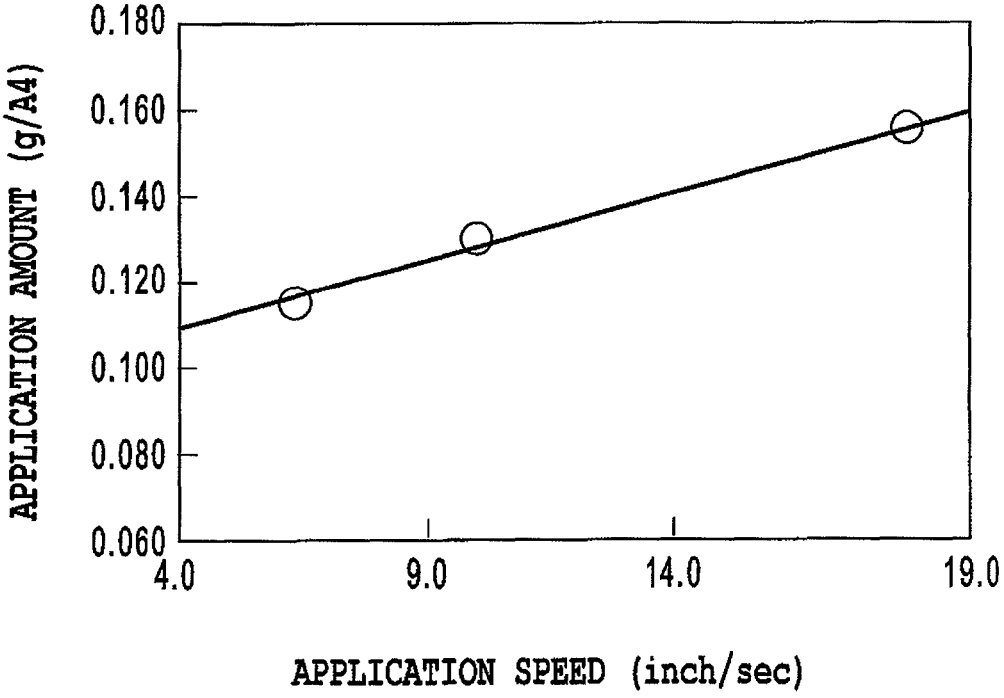
FIG. 16 is a diagram illustrating the relationship between application speed and the application amount.

When the applying roller 1001 rotates, the flow resistance of the applying roller surface moves the application liquid L filled in the liquid holding space S, in the rotating direction. The application liquid L is then fed to the abutting portion between the applying roller 1001 and the lower edge 2011 of the abutting member 2009 of the liquid holding member 2001 against the pressing force of the abutting member 2009 against the applying roller 1001. That is, increasing the rotation speed of the applying roller increases the moving speed of the application liquid and thus the resistance to the abutting member 2009. The increased resistance increases the displacement of the abutting portion N and thus the amount of application liquid passing through the abutting portion N. FIG. 16 is a diagram showing the relationship between the application amount and rotation speed (application speed) of the applying roller. As is apparent from the figure, increasing the application speed increases the application amount. Thus, control can be performed on the basis of the rotation speed of the applying roller. Then, a possible variation in the application amount associated with the individual variability can be inhibited by controlling the rotation speed in accordance with the parameter (individual variability information) based on the individual variability affecting the application amount stored and held in the EEPROM 5020.

The application speed determining process in accordance with the present embodiment determines the application speed, which can be associated with the application amount as described above, on the basis of the parameter associated with the variation in application amount. This allows control to be performed so as to maintain a fixed application amount regardless of a variation in application amount depending on the individual variability.

During the subsequent applying step, an applying operation is performed at the thus determined application speed (steps S6 and S7).

1.5.5. Applying Step

The applying roller starts rotating clockwise at the rotation speed determined in step 5 as shown by an arrow in FIG. 2 (step S6). The rotation of the applying roller 1001 allows the application liquid L filled in the liquid holding space S to run through the abutting portion N between the applying roller 1001 and the lower edge 2011 of the abutting member 2009 against the pressing force of the abutting member 2009 of the liquid holding member 2001 exerted on the applying roller 1001. The application liquid is then attached to the outer periphery of the applying roller 1001 so as to form a layer. The application liquid L attached to the applying roller 1001 is fed to the abutting portion between the applying roller 1001 and the counter roller 1002.

Figure 9:
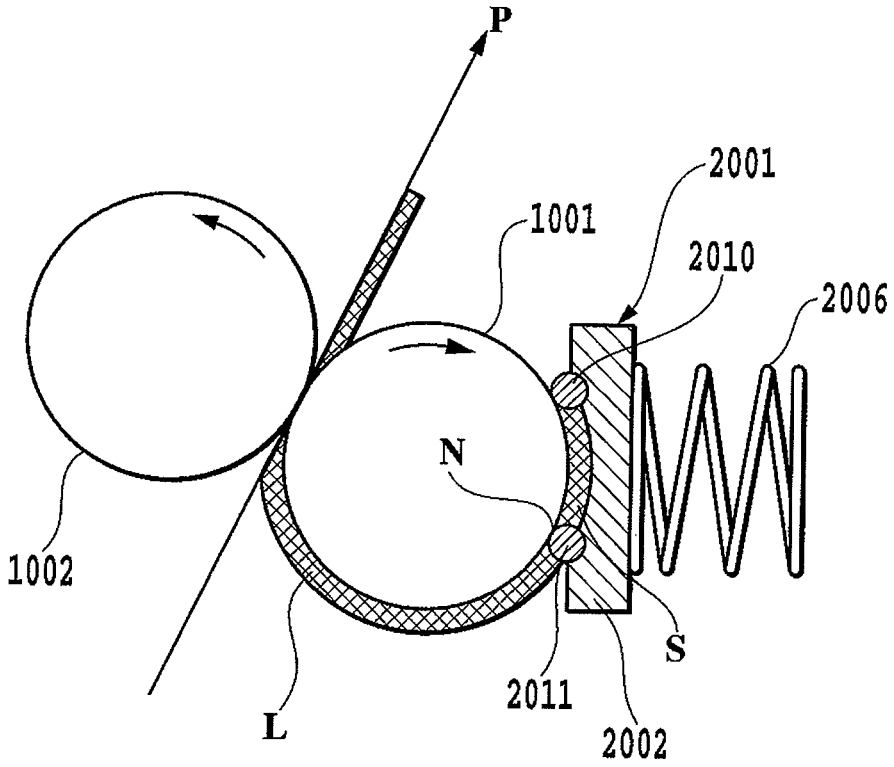
FIG. 9 is a vertical sectional view showing how a applying liquid is filled into a liquid holding space formed by the liquid holding member and the applying roller and how a liquid is applied to a applying medium by the rotation of the applying roller.

Then, the applying medium feeding mechanism 1006 conveys the applying medium to between the applying roller 1001 and the counter roller 1002. At the same time, the applying medium is interposed between the rollers and conveyed toward the sheet discharging section (step S6). During the conveyance, the application liquid applied to the outer peripheral surface of the applying roller 1001 is transferred from the applying roller 1001 to the applying medium P as shown in FIG. 9. The amount of application liquid transferred is controlled to a given value by controlling the circulation speed and the application speed as described above.

Of course, the means for feeding the applying medium to between the applying roller 1001 and the counter roller 1002 is not limited to the above-described feeding mechanism. Any such means may be used, for example, a combination with manual means supplementarily using a predetermined guide member, or the unitary manual means.

In FIG. 9, a portion expressed by crossing oblique lines indicates the application liquid L. Here, the thickness of the layer of the application liquid with respect to the applying roller 1001 and the applying medium P is exaggerated compared to the actual thickness in order to clearly show how the application liquid L is applied.

As described above, a portion of the applying medium P to which the application liquid has been applied is conveyed in the direction of the arrow by the conveying force of the applying roller 2001. At the same time, a portion of the applying medium P to which the application liquid is unapplied is conveyed to the contact portion between the applying medium P and the applying roller 2001. This operation is continuously or intermittently performed to apply the application liquid to the entire application medium.

FIG. 9 shows the ideal application state in which all of the application liquid L having pass through the abutting member 2009 and attached to the applying roller 2001 is transferred to the applying medium P. However, in actuality, not all of the application liquid attached to the applying roller 1001 is transferred to the applying medium P. That is, when the conveyed applying medium P leaves the applying roller 1001, the application liquid L may be attached to the applying roller 1001 and remain on the applying roller 1001. The application liquid L remaining on the applying roller 1001 passes through between the applying roller 1001 and the upper edge of the abutting member 2009 and returns into the liquid holding space S against the pressing force of the abutting member 2009 of the liquid holding member 2001. The application liquid L is then mixed with the application liquid already filled in the space S.

Figure 10:
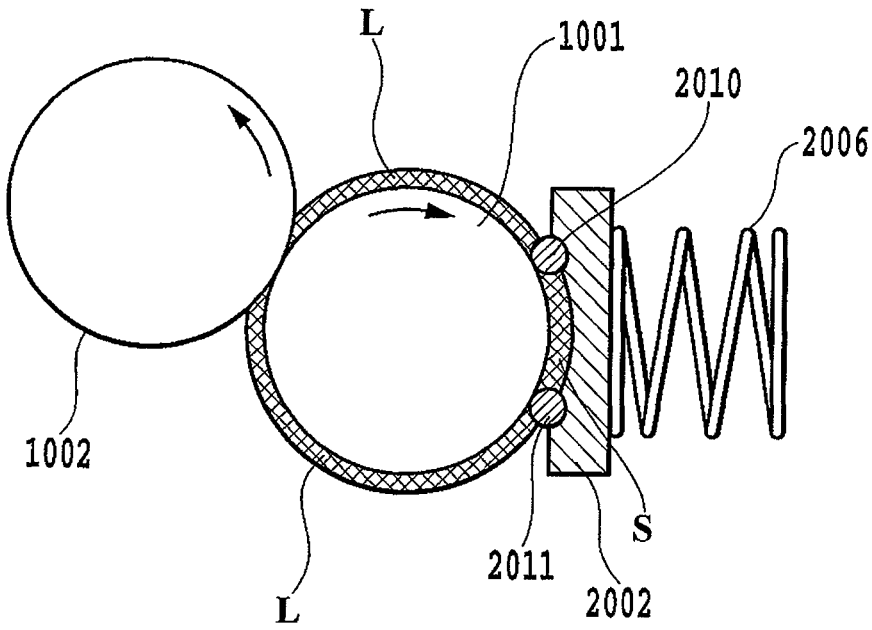
FIG. 10 is a vertical sectional view showing how the applying liquid is filled into the liquid holding space formed by the liquid holding member and the applying roller and how the applying roller is rotated when no applying medium is present.

The operation of returning the application liquid is similarly performed if the applying roller 1001 is rotated with no applying medium present as shown in FIG. 10. That is, rotation of the applying roller 1001 allows the application liquid attached to the outer periphery of the applying roller 1001 to pass through the portion (nip portion) between the applying roller 1001 and the counter roller 1002. After passing through the nip portion, the application liquid is separated into two flows toward the applying roller 1001 and the counter roller 1002, respectively, with a certain amount of application liquid remaining on the applying roller 1001. The application liquid L attached to the applying roller 1001 passes through between the upper edge 2010 of the abutting member 2009 and the applying roller 1001 and enters the liquid holding space S. The application liquid L is then mixed with the application liquid filled in the space S.

1.5.6. Finishing Step

Once the operation of applying the liquid to the applying medium has been performed as described above, the apparatus determines whether or not to finish the applying step. If the applying step is not to be finished, the process returns to step S7 to repeat the applying operation until the applying step is executed on the all the parts of the applying medium to which the liquid needs to be applied. When the applying step is finished, the applying roller 1001 is stopped (step S9). Moreover, the driving of the pump 3007 is stopped (step S10) Subsequently, the process shifts to step S2 to repeat the operations from step S2 to step S10 if an applying start instruction is input. If the applying start instruction is not input, a post-process is executed such as a collecting operation of collecting the application liquid from the liquid holding space S and liquid channels (step S9). Then, the applying process is finished.

The collecting operation is performed by driving the pump 3007 for a given time with the shut-off valves set for the open and close combination for the "collection" state. This open and close combination allows the buffer tank 3002 to communicate with the liquid applying space S through the second channel, while allowing the first channel to communicate with the communication port 3008, the air communication port, for the liquid applying space S. This allows the air to be supplied to the tube 3102, liquid applying space S, tube 3103, tube 3104, pump 3007, and tube 3105. The application liquid filled in the space is collected in the buffer tank 3002. The collecting operation makes it possible to completely prevent or reduce the evaporation of the application liquid from the liquid holding space S.

After the collecting operation, the shut-off valves are set for the open and close combination for the "uncontrolled" state. This open and close combination causes the replacement tank 3001, buffer tank 3002, and liquid applying space S to be shut off against one another. This makes it possible to prevent or reduce the movement of the application liquid between the tanks and the flow of the application liquid to the exterior even if the posture of the apparatus is tilted during movement, transportation, or the like.

1.5.7. Example of Determination of Circulation Speed and Application Speed Based on Individual Variability As described for steps S3 and S5 in the flowchart in FIG. 3, the present embodiment determines the circulation speed and the application speed depending on a variation in application amount associated with the individual variability. That is, the circulation speed and the application speed are determined on the basis of the individual variability information stored and held in the EEPROM 4020. Description will be given of a specific example of a method for determining the circulation speed and the application speed.

Figure 17:
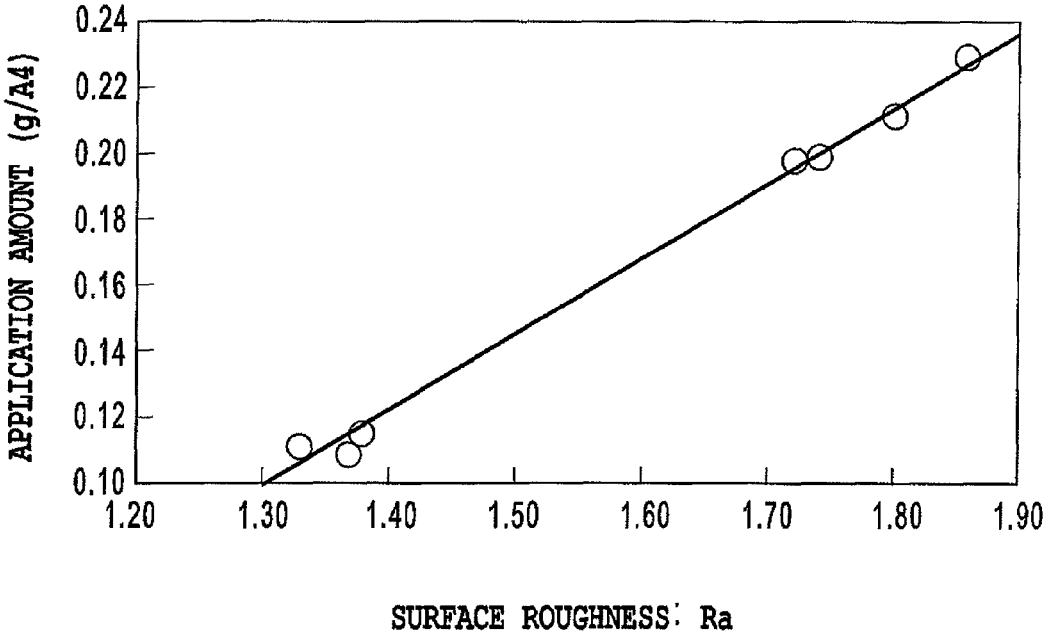
FIG. 17 is a diagram illustrating the relationship between the application amount and the surface roughness of applying roller.

FIG. 17 is a diagram showing the relationship between the application amount and the surface roughness as a surface property of the applying roller 2001. As is apparent from the figure, the application amount increases with the surface roughness.

The high surface roughness of the applying roller means that the applying roller 2001, to which the application liquid attaches, has significant concaves and convexes. Thus, the amount of application liquid attached to the applying roller 2001 increases with the surface roughness of the applying roller 2001. Furthermore, the components of the liquid applying member have various types of individual variability affecting the application amount as described below. However, the major factor of a variation in application amount associated with the individual variability is a variation in surface roughness resulting from polishing during the manufacture of the applying roller.

Thus, the present embodiment measures the surface roughness of the applying roller 2001, installed in the main body portion of the liquid applying apparatus during the step of manufacturing the main body portion. Then, an input operation section 4004 is used to store and hold a surface roughness parameter based on the surface roughness in the EEPROM 4020. For example, Ra (arithmetic surface roughness) of less than 1.3 is defined as level 1, Ra of at least 1.3 and less than 1.6 is defined as level 2, and Ra of at least 1.6 is defined as level 3. These surface roughness levels 1 to 3 are stored and held as surface roughness parameters.

Setting the surface roughness parameter in the EEPROM allows the CPU 4001 to determine the circulation speed and the application speed on the basis of the table shown in FIG. 18. That is, in FIG. 18, a "pump speed" that is the driving speed of the pump 3007 and the "application speed", the rotation speed of the applying roller 2001, are set at the values obtained by corrections based on input surface roughness parameter. In the figure, the pump speeds A, B, and C are arranged in order of increasing speed, and the application speeds D, E, and F are also arranged in order of increasing speed. Accordingly, when the surface roughness parameter stored in the EEPROM is the level 1, the application amount decreases relatively. Thus, in order to obtain the desired application amount, the low speed A is selected as the pump speed (step S3), and the high speed F is selected as the application speed (step S4). When the surface roughness parameter is the level 3, the application amount increases relatively. Thus, in order to obtain the desired application amount, the high speed C is selected as the pump speed (step S3), while the low speed D is selected as the application speed (step S5).

Thus, the present embodiment controls both the rotation speed of the pump 3007 and the rotation speed of the applying roller 2001 on the basis of the surface roughness parameter (individual variability information). This enables the application amount to be adjusted more accurately than the control of only one of the rotation speeds. However, the present invention is not limited to this. Only the pump speed or the rotation speed of the applying roller may be controlled on the basis of the surface roughness parameter depending on the accuracy of the control of the application amount using the pump, the accuracy of the control of the application amount based on the rotation speed of the applying roller, or the like. For example, with the rotation speed of the applying roller fixed, the application amount may be adjusted by controlling the rotation speed (the flow speed in the liquid holding space) of the pump.

As shown in FIG. 15, the application amount decreases with increasing flow speed. Consequently, the individual variability varying the circulating flow rate, specifically, the individual variability of the pump 3007, is one of the factors determining the amount (application amount) of application liquid attached to the applying roller 2001 and then carried out of the liquid holding space S. Thus, like the surface roughness parameter, the flow rate of the pump, installed in the main body during the manufacturing process, may be measured. A flow rate parameter based on the flow rate measurement may then be stored and held in the EEPROM as individual variability information. The application amount may then be adjusted on the basis of the flow rate parameter stored in the EEPROM as individual variability information.

Furthermore, when the individual variability of the abutting member 2009 varies the abutting pressure on the applying roller 2001, a variation occurs in the state of a meniscus (capillary force acing on the application liquid) of the application liquid formed in the gap in the abutting portion N. The variation in the state of the abutting portion N varies the amount of application liquid passing out of the liquid holding space S through the gap in the abutting portion N. That is, the individual variability of the abutting pressure of the abutting member 2009 is one of the factors determining the amount of application liquid attached to and carried by the applying roller 2001. Thus, like the surface roughness parameter, the abutting pressure of the abutting member 2009, installed in the main body during the manufacturing process, may be measured. An abutting pressure parameter based on the abutting pressure may then be stored and held as individual variability information. The application amount may then be adjusted on the basis of the abutting pressure parameter stored in the EEPROM as individual variability information.

Moreover, the wettability of the surface of silicone rubber, a base material for the applying roller, also varies the state of a meniscus (capillary force acting on the application liquid) of the application liquid formed in the gap in the abutting portion. That is, the individual variability of the wettability of the applying roller is one of the factors determining the amount of application liquid attached to and carried by the applying roller. Thus, like the surface roughness parameter, the wettability of the applying roller, installed in the main body during the manufacturing process, may be measured. A wettability parameter based on the measurements may then be stored and held as individual variability information. The application amount may then be adjusted on the basis of the wettability parameter stored in the EEPROM as individual variability information.

Furthermore, in order to measure the individual variability of the application amount among applying apparatuses, application tests may be carried out during the manufacturing process, and the application amount may be measured on the basis of a change in the weight of the applying medium resulting from the application. In this case, on the basis of the measured application amount, an application amount parameter is determined and then stored and held as individual variability information. Specifically, the application amount parameter is determined and input as described below. First, in a manufacturing factory, an appropriate measuring instrument is used to measure the weight of an applying medium with no application liquid or ink applied thereto. Then, a liquid applying apparatus with the initialized parameter is used to perform an applying operation on an applying medium with the application amount for the applying medium set at a preset value. A measuring instrument is then used to measure the weight of the applying medium with the application liquid applied thereto to determine the difference between the weight of the applying medium after the application and the weight of the applying medium before the application. The difference corresponds to the weight (absolute amount) of the application liquid actually applied to the applying medium. A parameter corresponding to the absolute amount of the application liquid is then input to the applying apparatus from an input section thereof and thus stored and held in a storage section (for example, the EEPROM 4020) of the applying apparatus. The absolute amount of the application liquid is classified into a plurality of levels (for examples, five levels, level 0 to 4). One of the levels which corresponds to the absolute amount of the application liquid is input to the apparatus as a parameter (individual variability information), with the value held in the storage section. Thus, setting the application amount parameter in the storage section allows the applying apparatus to control, in the subsequent applying operation, at least one of the rotation speed of the applying roller and the pump speed on the basis of the parameter held in the storage section. The application amount may thus be adjusted on the basis of the application amount parameter as individual variability information.

The input of the parameter corresponding to the absolute amount of the application amount is commonly performed in the manufacturing factory before shipment. However, even after the shipment, the applying apparatus can be provided with a mode (serviceman mode) in which serviceman can vary the parameter corresponding to the absolute amount of the application amount. That is, even after the shipment, the service personnel can use the measuring instrument for the medium application amount to measure the actual application amount. Thus, the parameter may be input in accordance with the measured application amount. Then, at least one of the rotation speeds of the applying roller and pump is determined in accordance with the thus newly input parameter to adjust the application amount. With this aspect, even if the application amount is varied in association with the use of the liquid applying apparatus, this temporal variation can be corrected.

Furthermore, the above plural pieces of individual variability information may be combined together for application. That is, at least one of the rotation speeds of the applying roller and pump is determined on the basis of the plural pieces of individual variability information.

Alternatively, the parameter (user adjustable parameter) may be stored and held in the EEPROM or the like so as to allow the user to adjust the amount of application liquid from the input operation section for a purpose different from the correction of a variation in application amount caused by the individual variability.

2. Embodiments of the Ink Jet Printing Apparatus 2.1. General Configuration

Figure 19:
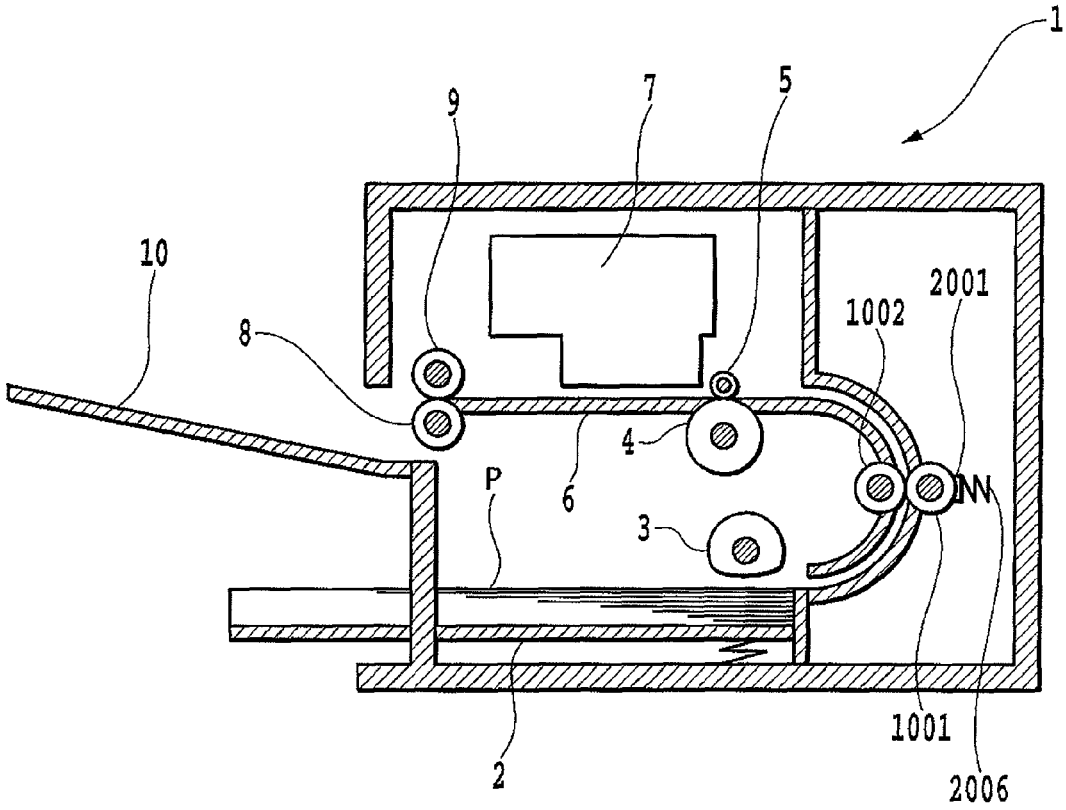
FIG. 19 is a vertically sectional view schematically showing the configuration of an ink jet printing apparatus according to another embodiment of the present invention.

FIG. 19 is a diagram generally showing the configuration of an ink jet printing apparatus 1 comprising an applying mechanism having almost the same configuration as that of the above liquid applying apparatus.

The ink jet printing apparatus 1 is provided with a feeding tray 2 on which a plurality of print media P are stacked. A semicircular separating roller 3 separates each print medium P from the others stacked on the feeding tray and then feeds it to a conveying path. The applying roller 1001 and the counter roller 1002 are arranged in the conveying path; the applying roller 1001 and the counter roller 1002 constitute liquid applying unit of the liquid applying mechanism. The print medium P fed from the feeding tray 2 is then fed to between the rollers 1001 and 1002. The applying roller 1001 is rotated clockwise in FIG. 19 by the rotation of a roller driving motor. The applying roller 1001 applies the application liquid to a print surface of the print medium P while conveying the print medium P. The print medium P to which the application liquid has been applied is fed to between a conveying roller 4 and a pinch roller 5. Then, the conveying roller 4 is rotated counterclockwise in the figure to convey the print medium P on a platen 6. The print medium P then moves to a position opposite to a print head 7 constituting printing means. The print head 7 is of an ink jet type in which a predetermined number of nozzles for ink ejection are disposed. While the print head 7 is being scanned in a direction perpendicular to the sheet of the drawing, printing is carried out by ejecting ink droplets from the nozzles to the print surface of the print medium P in accordance with print data. An image is formed on the print medium by alternately repeating a printing operation and a conveying operation performed by the conveying roller 4 to convey the print medium by a predetermined amount. Simultaneously with this image forming operation, the print medium P is sandwiched between a sheet discharging roller 8 and a sheet discharging spur 9 both provided downstream of the scan area of the print head in the conveying path for the print medium. The print medium P is then discharged onto a sheet discharging tray 10 by the rotation of the sheet discharging roller 8.

As this ink jet printing apparatus, what is called a full line type can be constructed in which an elongate print head having nozzles from which inks are ejected and which are disposed over the maximum width of the print medium is used to perform a printing operation.

The application liquid used in the present embodiment is a treatment liquid that facilitates the coagulation of pigments when inks composed of the pigments as color materials are used for printing. In the present embodiment, the treatment liquid is used as an application liquid to react with the pigments, which are the color materials of the inks ejected to the print medium to which the treatment liquid has been applied. This facilitates the coagulation of the pigments. The facilitation of the coagulation of the pigments improves the printing density. Moreover, it is possible to suppress or prevent bleeding. The application liquid used in the ink jet printing apparatus is not limited to the above example.

Figure 20:
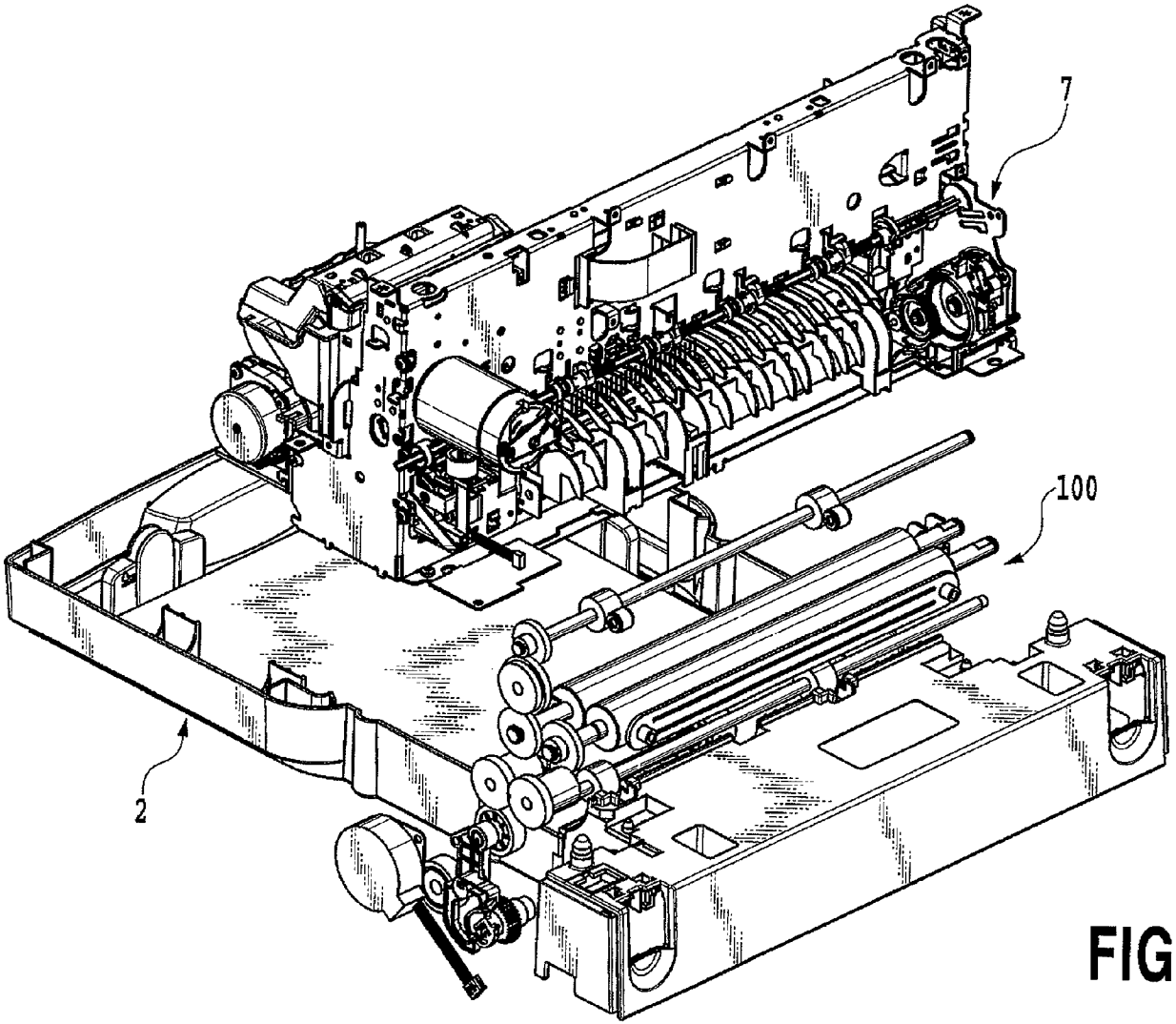
FIG. 20 is a perspective view showing an essential part of the ink jet printing apparatus shown in FIG. 19.

FIG. 20 is a perspective view showing an essential part of the above ink jet printing apparatus. As shown in the figure, an applying mechanism 100 is provided above one end of the feeding tray 2. A printing mechanism comprising the print head 7 and the like is provided above the applying mechanism 100 and above a central portion of the feeding tray 2.

Figure 21:
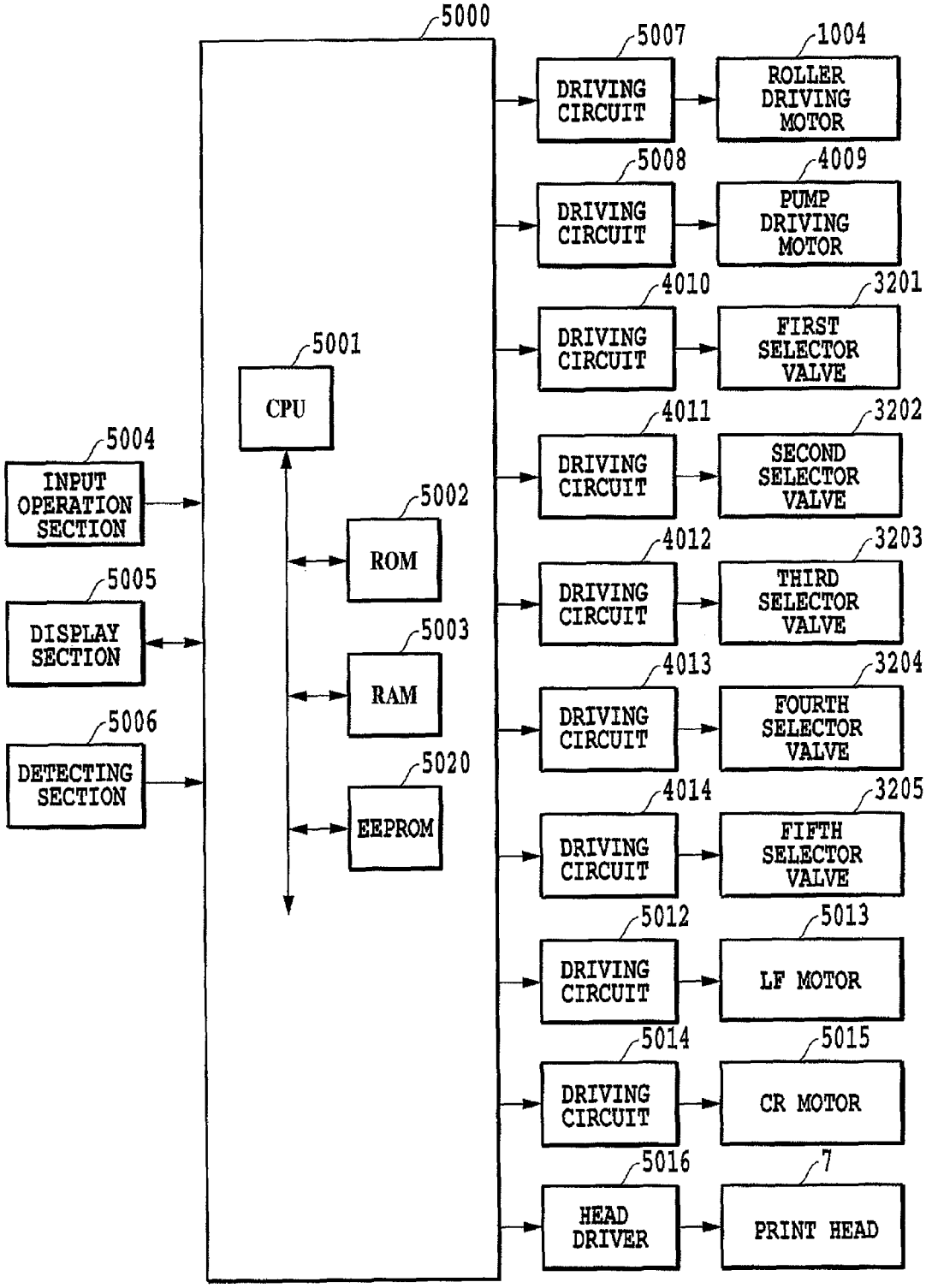
FIG. 21 is a block diagram schematically showing the configuration of a control system for the ink jet printing apparatus shown in FIG. 19.

FIG. 21 is a block diagram showing a control arrangement for the above ink jet printing apparatus. In this figure, the roller driving motor 1004, the pump driving motor 4009, and the actuator 3005 for the air communicating valve, all of which are elements of the liquid applying mechanism, are similar to those descried for the liquid applying apparatus. A controller 5000 has an EEPROM 5020 as well as the above embodiment o In accordance with a program of a process procedure described later in FIG. 23, a CPU 5001 controls the driving of the elements of the applying mechanism. The CPU 5001 also controls the driving of an LF motor 5013, a CR motor 5015, and the print head 7 which relate to the printing mechanism, via driving circuits 5012 and 5014 and a head driver 5016. That is, driving by the LF motor 5013 rotates the conveying roller 4. Driving by the CR motor moves a carriage on which the print head 7 is mounted. Moreover, the CPU 5001 performs control such that inks are ejected through the nozzles in the print head.

2.2. Sequence of an Printing Operation

FIG. 23 is a flowchart showing the procedure of liquid application and an accompanying printing operation in the ink jet printing apparatus according to the present embodiment. In the figure, the processing during steps S101, during S103 to S108, and during S110 to S113 is similar to that during step S1, during steps S3 to S7, and during steps S9 to S11, all the steps being shown in FIG. 13.

Figure 22:
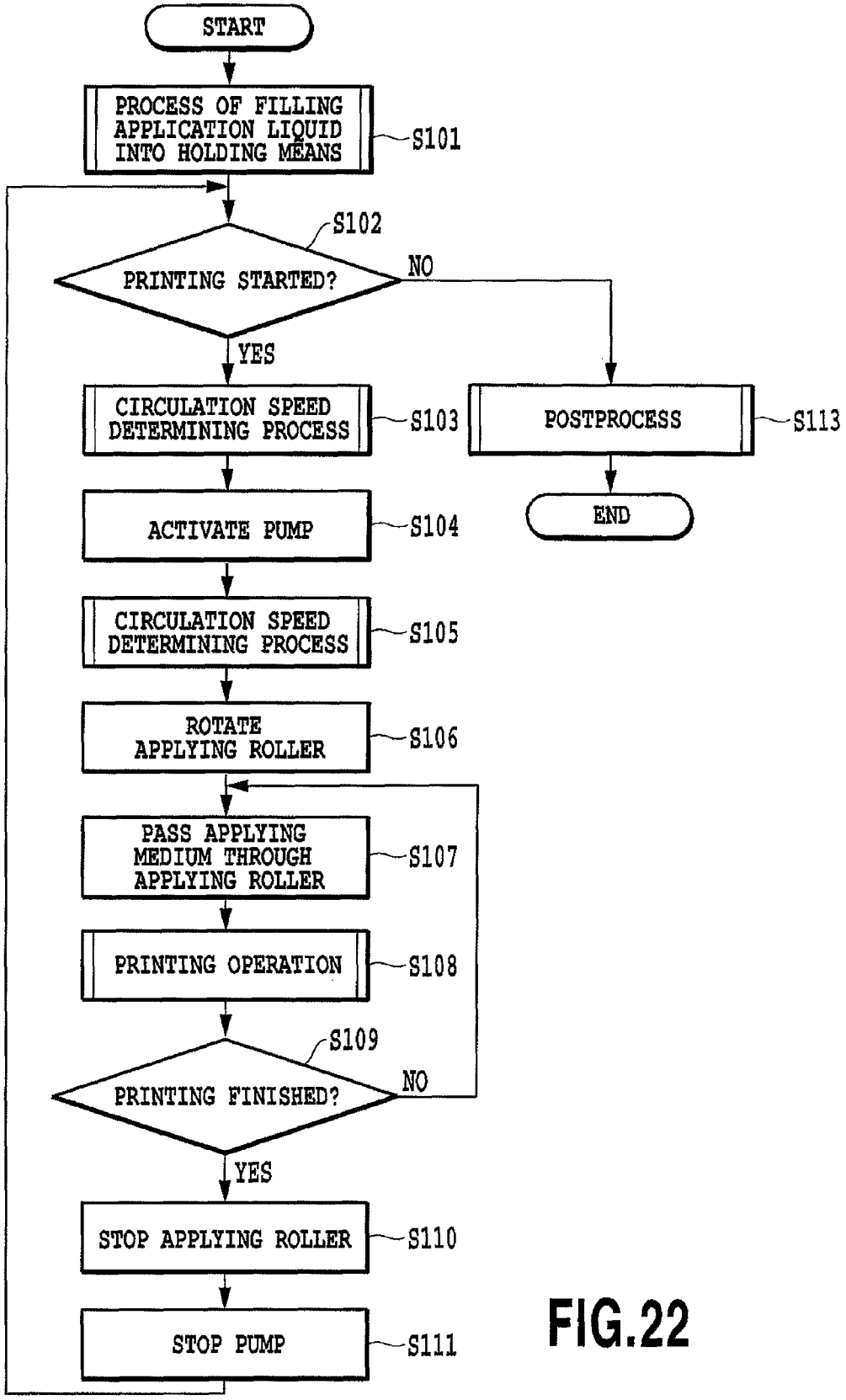
FIG. 22 is a flowchart showing sequences of a liquid applying operation and a printing operation performed in the ink jet printing apparatus shown in FIG. 19.

As shown in FIG. 22, in the present embodiment, a print start instruction is given (step S102). Then, a series of liquid applying operations such as pump activation are performed (steps S103 to S107).

After this applying step, a printing operation is performed on a print medium having the application liquid applied to desired parts of the medium (step S108). That is, the print head 7 is scanned over the print medium P conveyed by the conveying roller 4 by a predetermined amount at a time. During the scan, inks are ejected from the nozzles in accordance with print data so as to adhere to the print medium to form dots. The adhering inks react with the application liquid, thus improving the density and preventing bleeding. The conveyance of the print medium and the scanning of the print head are repeated to print the print medium P. The finished print medium is discharged onto the sheet discharging tray 10. When the apparatus determines in step S109 that the printing has been finished, the processing in step S110 and the subsequent steps is executed to finish the present process.

In the present embodiment, as the liquid is applied to the print medium, printing is sequentially executed on parts of the print medium to which the liquid has already been applied. That is, the conveying path from the conveying roller to the print head is shorter than the print medium, and when a part of the print medium to which the liquid has already been applied reaches the scan area of the print head, the applying mechanism applies the liquid to another part of the print medium. Every time the print medium is conveyed by a predetermined amount, liquid application and printing are sequentially executed on different parts of the print medium. However, in an alternative form of application of the present invention, printing may be carried out after one print medium has been completely applied the application liquid.

Further, in the printing apparatus of the present invention, the degree of whiteness of the medium can be improved by using a liquid containing a fluorescent whitening agent as an application liquid. The printing means after the liquid application is not limited to the ink jet printing system. Effects can be produced using a printing system such as a thermal transfer system or an electrophotographic system. In a silver salt-based printing apparatus, a photosensitive agent as the application liquid may be applied before printing.

3. Another Embodiment

In the embodiment described above, the illustrated liquid applying apparatus uses the applying roller as applying means. However, the applying means is not limited to the applying roller, and another configuration may be adopted. For example, the applying means may be composed of an endless belt moving in contact with the abutting portion of the liquid holding member. The endless belt may move circularly to feed the applying liquid in the application liquid holding space S from the abutting portion to the exterior to apply the application liquid to the applying medium. In short, any configuration may be applied to the applying means provided that the configuration can contact the liquid holding member to form a liquid holding space and feed the liquid attached in the liquid holding space to the exterior to apply the liquid to the applying medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-333363, filed Dec. 11, 2006, 2007-275478, filed Oct. 23, 2007 which are hereby incorporated by reference herein in their entirety.

What is claimed is:

1. A liquid applying apparatus comprising:

a liquid applying unit comprising an applying roller that applies a liquid to a medium, a liquid holding member that abuts against the applying roller to form a liquid holding space in which a liquid is held, and a pump for supplying the liquid to the liquid holding space to generate a flow of the liquid in the liquid holding space, the applying roller and the pump being rotated to apply the liquid in the liquid holding space to the medium via the applying roller;

a memory configured to store information on individual variability of components of the liquid applying unit; and a control unit configured to adjust both (i) a rotation speed of the applying roller and (ii) a rotation speed of the pump to change a flow speed of the liquid in the liquid holding space for adjusting the amount of the liquid applied to the medium, on the basis of the information stored in the memory, wherein the individual variability information is at least one of information indicating a difference in a surface property of the applying roller and information indicating a difference in abutting pressure between the liquid holding member and the applying roller.

2. The liquid applying apparatus according to claim 1, wherein the surface property is surface roughness.

3. The liquid applying apparatus according to claim 1, wherein the surface property is wettability of the applying roller by the liquid.

4. The liquid applying apparatus according to claim 1, wherein the pump allows the liquid to flow from a liquid supply port that is in communication with an interior of the liquid holding space to a liquid collecting port that is in communication with the liquid holding space, wherein the individual variability information is information indicating a difference in the flow speed of the liquid which occurs in the liquid holding space.

5. The liquid applying apparatus according to claim 1, wherein the pump is provided at a liquid channel connected to the liquid holding space.

6. An ink jet printing apparatus comprising:

a liquid applying unit comprising an applying roller that applies a liquid to a medium, a liquid holding member that abuts against the applying roller to form a liquid holding space in which a liquid is held, and a pump for supplying the liquid to the liquid holding space to generate a flow of the liquid in the liquid holding space, the applying roller and the pump being rotated to apply the liquid in the liquid holding space to the medium via the applying roller;

a print head that ejects ink to the medium to which the liquid has been applied by the liquid applying unit;

a memory configured to store information on individual variability of components of the liquid applying unit; and a control unit configured to adjust both (i) a rotation speed of the applying roller and (ii) a rotation speed of the pump to change a flow speed of the liquid in the liquid holding space for adjusting the amount of the liquid applied to the medium, on the basis of the information stored in the memory, wherein the individual variability information is at least one of information indicating a difference in a surface property of the applying roller and information indicating a difference in abutting pressure between the liquid holding member and the applying roller.

7. The ink jet printing apparatus according to claim 6, further comprising an input unit for inputting the information in order to store the information in the memory.

* * * * *